US012139871B1

(12) United States Patent
Gillen

(10) Patent No.: US 12,139,871 B1
(45) **Date of Patent: *Nov. 12, 2024**

(54) PRECAST DEEP FOUNDATION SYSTEM

(71) Applicant: Glenn P. Gillen, Metairie, LA (US)

(72) Inventor: Glenn P. Gillen, Metairie, LA (US)

( * ) Notice: Subject to any disclaimer, the term of this patent is extended or adjusted under 35 U.S.C. 154(b) by 426 days.

This patent is subject to a terminal disclaimer.

(21) Appl. No.: 17/510,083

(22) Filed: Oct. 25, 2021

Related U.S. Application Data

(63) Continuation of application No. 16/567,576, filed on Sep. 11, 2019, now Pat. No. 11,155,976.

(60) Provisional application No. 62/729,980, filed on Sep. 11, 2018.

(51) Int. Cl.
*E02D 27/12* (2006.01)
*E04H 12/16* (2006.01)
*E02D 27/42* (2006.01)

(52) U.S. Cl.
CPC ..... *E02D 27/12* (2013.01); *E04H 12/16* (2013.01); *E02D 27/42* (2013.01); *E02D 2250/0023* (2013.01); *E02D 2300/002* (2013.01)

(58) Field of Classification Search
CPC . E02D 27/12; E02D 2250/0023; E02D 27/42; E02D 2300/002; E04H 12/16
USPC ..... 52/157, 169.9, 294, 296; 405/229, 230, 405/244
See application file for complete search history.

(56) References Cited

U.S. PATENT DOCUMENTS 2,971,295 A * 2/1961 Reynolds ..... E02D 27/01 52/294
3,555,751 A * 1/1971 Thorgusen ..... E02D 19/04 249/40
4,707,964 A * 11/1987 Hoyt ..... E02D 27/42 52/165
5,546,710 A * 8/1996 Barry ..... E04H 13/003 52/157

(Continued)

*Primary Examiner* — Brian E Glessner
*Assistant Examiner* — Adam G Barlow
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A deep foundation system having an array of concrete blocks that preferably includes multiple rows of blocks and multiple columns of blocks. Each block preferably has an upper surface, a lower surface and a plurality of side portions. Each side portion can extend from the upper surface to the lower surface. The array of blocks can have an outermost edge or a peripheral portion. A plurality of open ended channels can be provided through the blocks, each channel preferably extending from one side portion to a different side portion. At least two of the channels can be spaced apart and in between a first and a second of the side portions. At least two of the channels can be spaced apart and in between a third and a fourth of the side portions. The tensile cable members preferably extend through multiple channels of multiple of the blocks and to the peripheral or outer edge portion. One or more openings can be provided in each block. The one or more openings each preferably extend from the upper surface to the lower surface. Each said opening can be positioned in between two of said tensile cable members. An inclined piling preferably extends through the block opening. A load transfer interface can transfer load from each block to inclined piling.

20 Claims, 26 Drawing Sheets

(56) References Cited

U.S. PATENT DOCUMENTS 5,707,180 A * 1/1998 Vickars ..... E21B 10/44 405/249
5,873,679 A * 2/1999 Cusimano ..... E04B 1/34347 405/251
6,050,038 A * 4/2000 Fey ..... H01Q 1/1242 52/223.7
6,074,133 A * 6/2000 Kelsey ..... E02D 35/00 405/251
6,200,070 B1 * 3/2001 Knight ..... E02D 27/48 405/230
6,244,009 B1 * 6/2001 Cerrato ..... E04H 9/021 52/592.1
6,298,611 B1 * 10/2001 Oliver ..... E02D 5/801 52/157
7,024,827 B2 * 4/2006 Gregory ..... E02D 27/02 52/294
7,618,217 B2 * 11/2009 Henderson ..... E02D 27/12 52/294
8,572,905 B1 * 11/2013 Driggers ..... E02D 27/42 52/298
8,667,750 B2 * 3/2014 Speer ..... E04B 2/16 52/582.1
8,714,880 B1 * 5/2014 Mitchell ..... E02D 35/005 405/230
8,720,139 B2 * 5/2014 Henderson ..... E02D 5/801 52/295
2002/0176749 A1 * 11/2002 Provost ..... E02D 35/00 405/252.1
2005/0144866 A1 * 7/2005 Chappell ..... E02D 27/01 52/294
2007/0269273 A1 * 11/2007 Henderson ..... E04H 12/085 405/231
2011/0170956 A1 * 7/2011 Vandenbulcke ..... E02D 27/50 405/227

* cited by examiner

PRECAST DEEP FOUNDATION SYSTEM

CROSS-REFERENCE TO RELATED APPLICATIONS

This application is a continuation of U.S. patent application Ser. No. 16/567,576, filed 11 Sep. 2019 (issued as U.S. Pat. No. 11,155,976 on Oct. 26, 2021), which claims the benefit of U.S. Provisional Patent Application Ser. No. 62/729,980, filed 11 Sep. 2018, which is hereby incorporated herein by reference.

Priority of U.S. Provisional Patent Application Ser. No. 62/729,980, filed 11 Sep. 2018, which is hereby incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an improved deep structural foundation for supporting a building or other superstructure wherein an improved post tension block mat array provides blocks with central openings that enable insertion of a piling into and through the block opening and to an underlying soil mass, wherein a specially configured interface transfers load from the mat array to the piling. In another embodiment, piling are initially installed followed by connection to the block array (or single block).

2. General Background of the Invention

Placement of certain buildings or like structures (or super structures) in remote areas often involves working with poor soil conditions. Remote locations also present construction problems. Some systems have been patented that use multiple blocks or block modules that are post tension by loading rods with tension, each rod extending through a chase of each block (e.g., U.S. Pat. No. 6,050,038). These rods can be positioned parallel and/or perpendicular to one other.

BRIEF SUMMARY OF THE INVENTION

The present invention provides a deep foundation system having an array of concrete blocks that can include multiple rows of blocks and multiple columns of blocks. Each block preferably has an upper surface, a lower surface and a plurality of side portions. Each side portion preferably extends from the upper surface to the lower surface. The array of blocks has an outermost edge or a peripheral portion.

A plurality of open ended channels can be provided through the blocks, each channel preferably extending from one side portion to a different side portion.

At least two of the channels can be spaced apart and in between a first and a second of the side portions.

At least two of the channels can be spaced apart and in between a third and a fourth of the side portions.

Tensile cable members preferably extend through multiple channels of multiple of the blocks and to the peripheral or outer edge portion.

One or more openings can be provided in each block. The one or more openings each preferably extend from the upper surface to the lower surface. Each said opening can be positioned in between two of said tensile cable members.

An inclined piling preferably extends through the block opening.

A load transfer interface preferably transfers load from each block to inclined piling.

The system of the present invention preferably does not depend on high compressive soil strengths at the surface because the loads are preferably transferred to the piers/piles.

The system of the present invention preferably reduces a need for many heavy blocks because the piers prevent uplift. Since piers are preferably used, the loading on the foundation is preferably increased. This preferably allows for bigger towers to be placed. The system of the present invention can be used when soil conditions are poor.

Preferably, the tensile cable member can be tensioned so that said blocks are preferably prestressed.

Preferably, the present invention includes a structure supported by the blocks and vertical pilings.

Preferably, the interface includes a mass of concrete that can be poured into each block opening.

Preferably, the interface includes reinforce steel that can be partially imbedded in each block and that extends into block opening.

Preferably, the tensile cable member can be tensioned so that said blocks are preferably post tensioned.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 8:
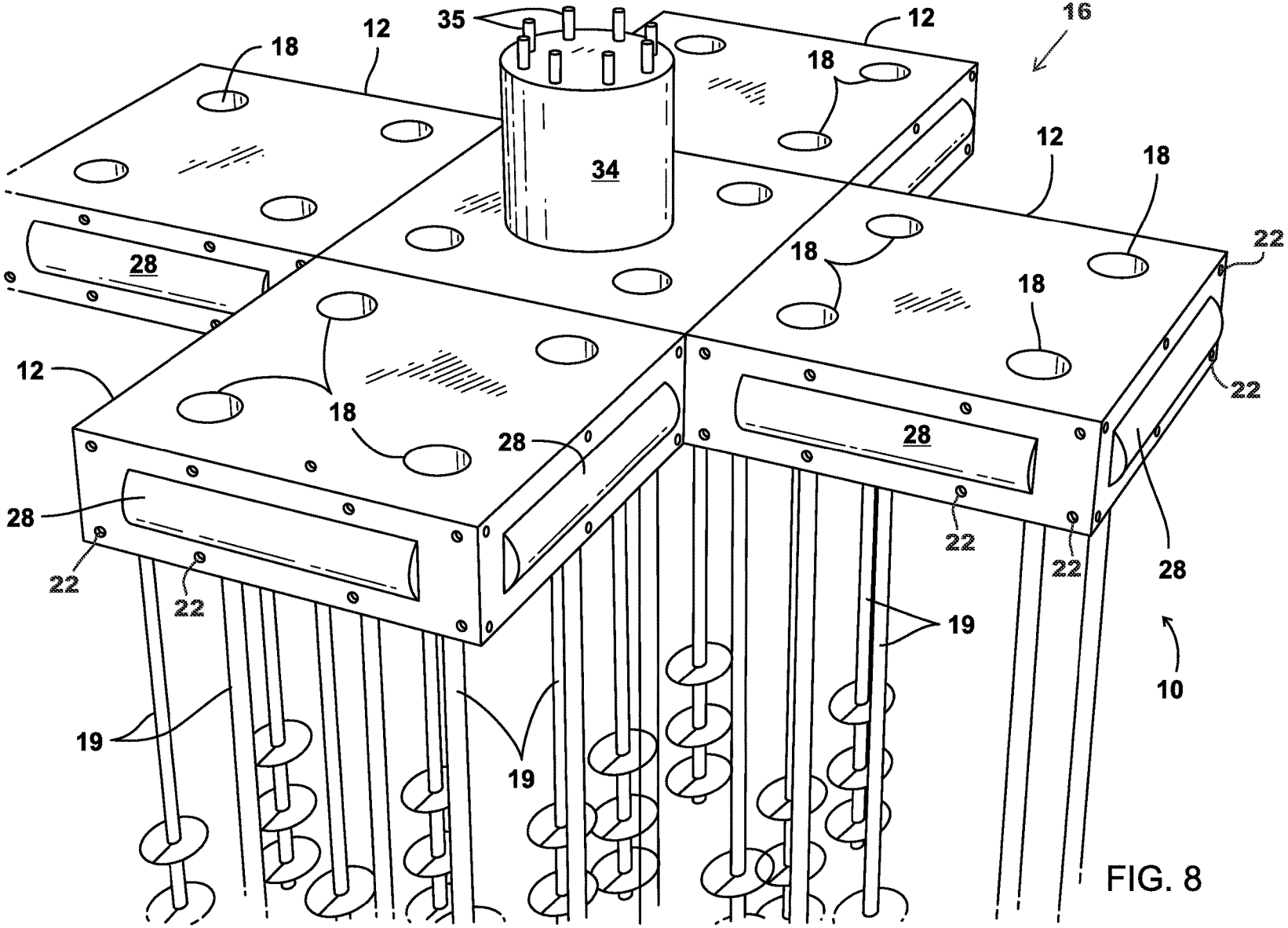
FIG. 8 is a perspective view of a preferred embodiment of the apparatus of the present invention.
Figure 9:
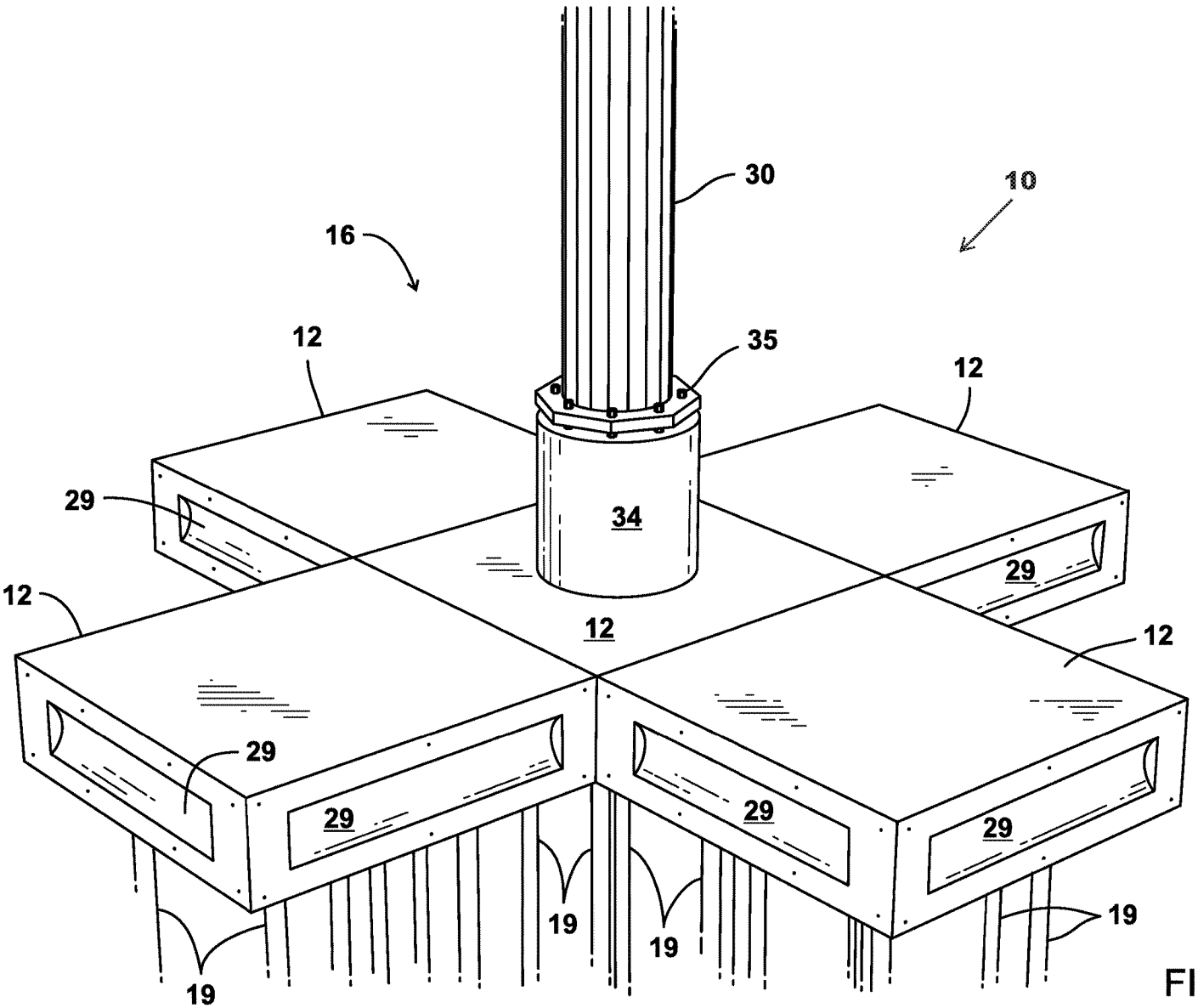
FIG. 9 is a perspective view of a preferred embodiment of the apparatus of the present invention.
Figure 16:
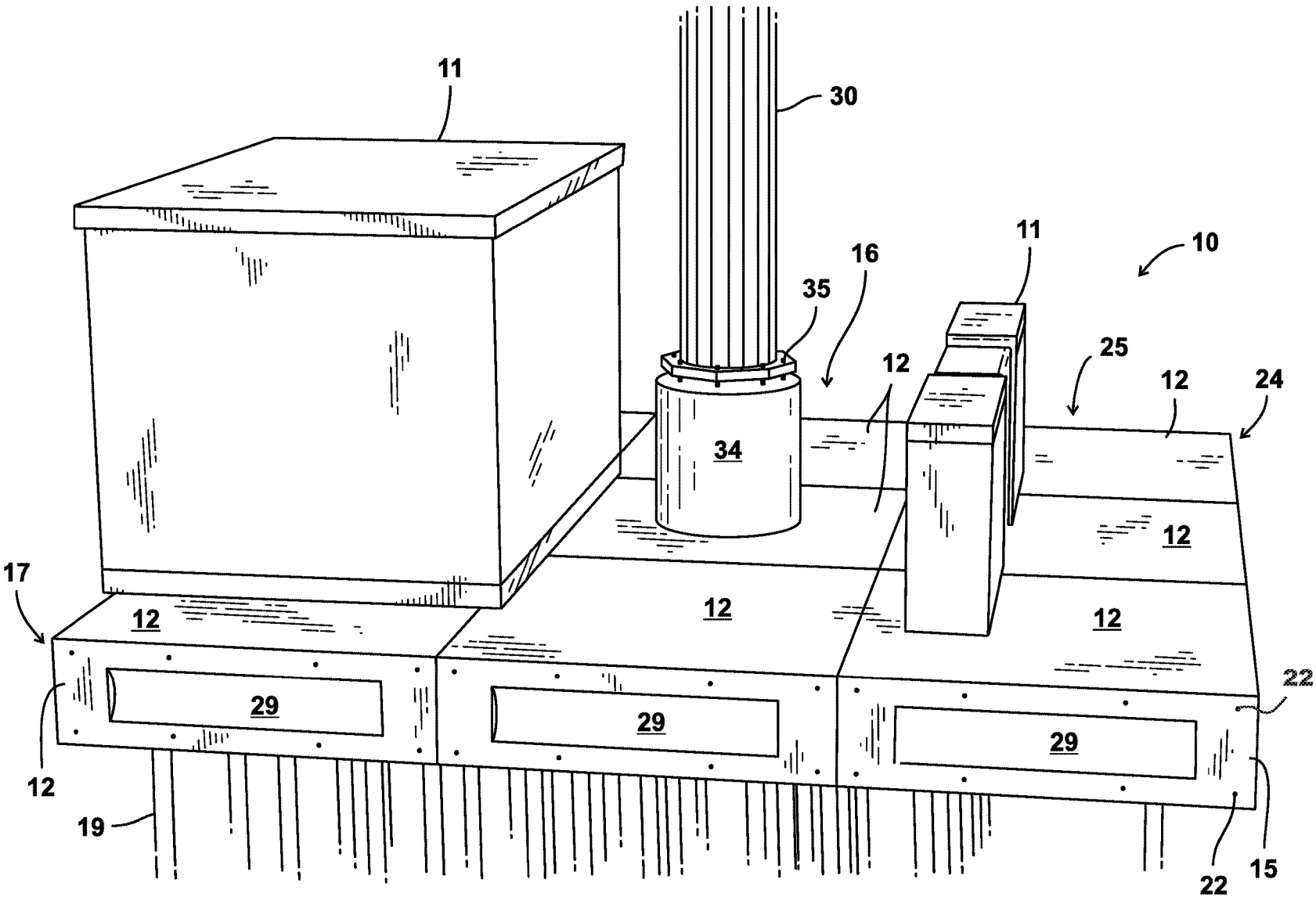
FIG. 16 is a perspective view of a preferred embodiment of the apparatus of the present invention.

FIGS. 8-9 and 16 show a preferred embodiment of the apparatus of the present invention designated generally by the numeral 10. FIGS. 9 and 16 are perspective views showing a deep foundation system 10 having an array 16 of concrete blocks 12 that preferably includes multiple rows 24 of blocks 12 and multiple columns 25 of blocks 12. The array 16 of blocks 12 can be used to support tower 30 upon pedestal 34 (with anchor bolts 35), a pole, multi leg tower or guyed tower. Array 16 of blocks 12 can also support buildings, housings or equipment 11 such as electrical equipment, antenna components/accessories or radios.

Each block 12 preferably has an upper surface 13, a lower surface 14 and a plurality of side portions 15. Each side portion 15 can extend from the upper surface 13 to the lower surface 14. The array 16 of blocks 12 can have an outermost edge or a peripheral portion 17 (see FIGS. 1-3 and 16). Each block 12 can have a tongue or projection 28 (i.e., tongue and groove male key) at some side portions 15 (e.g., two (2) side portions 15) and correspondingly shaped groove or recesses 29 (i.e., tongue and groove female key) at other (two (2) other) side portions 15 so that each projection 28 is preferably able to interlock with a recess 29 of another block 12 (e.g., tongue and groove interface).

Figure 1:
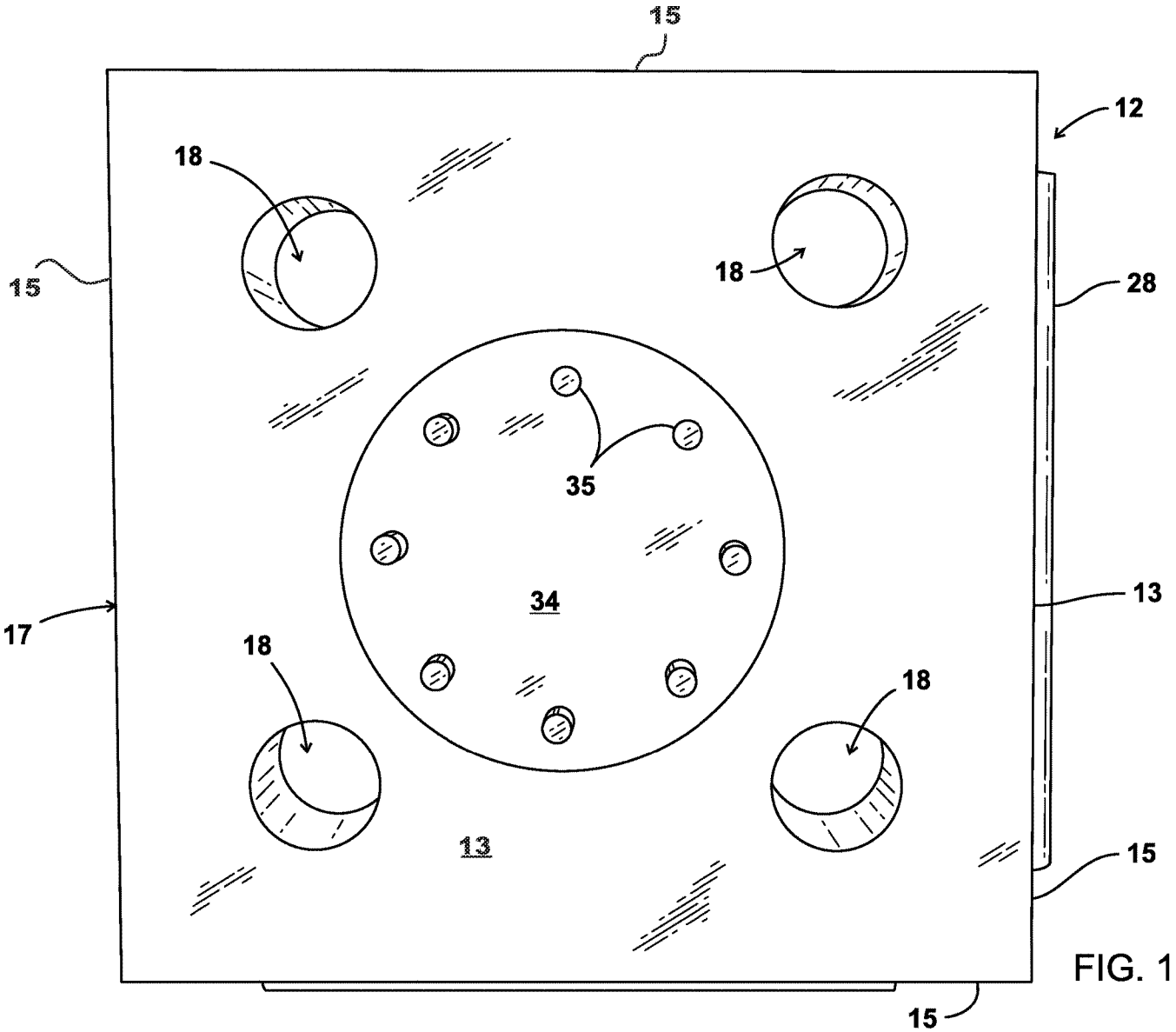
FIG. 1 is a partial top view of a preferred embodiment of the apparatus of the present invention.
Figure 2:
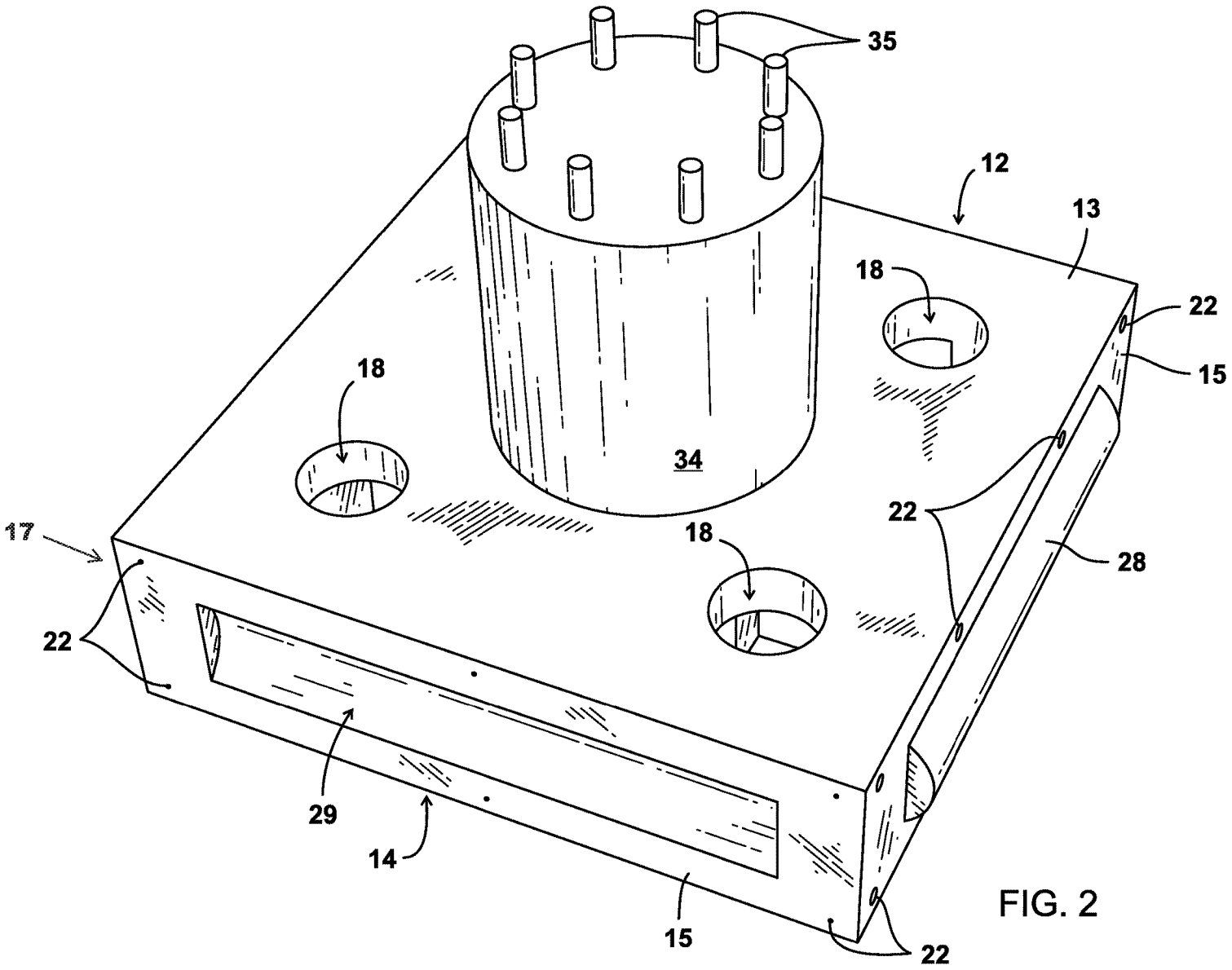
FIG. 2 is a partial perspective view of a preferred embodiment of the apparatus of the present invention.
Figure 3:
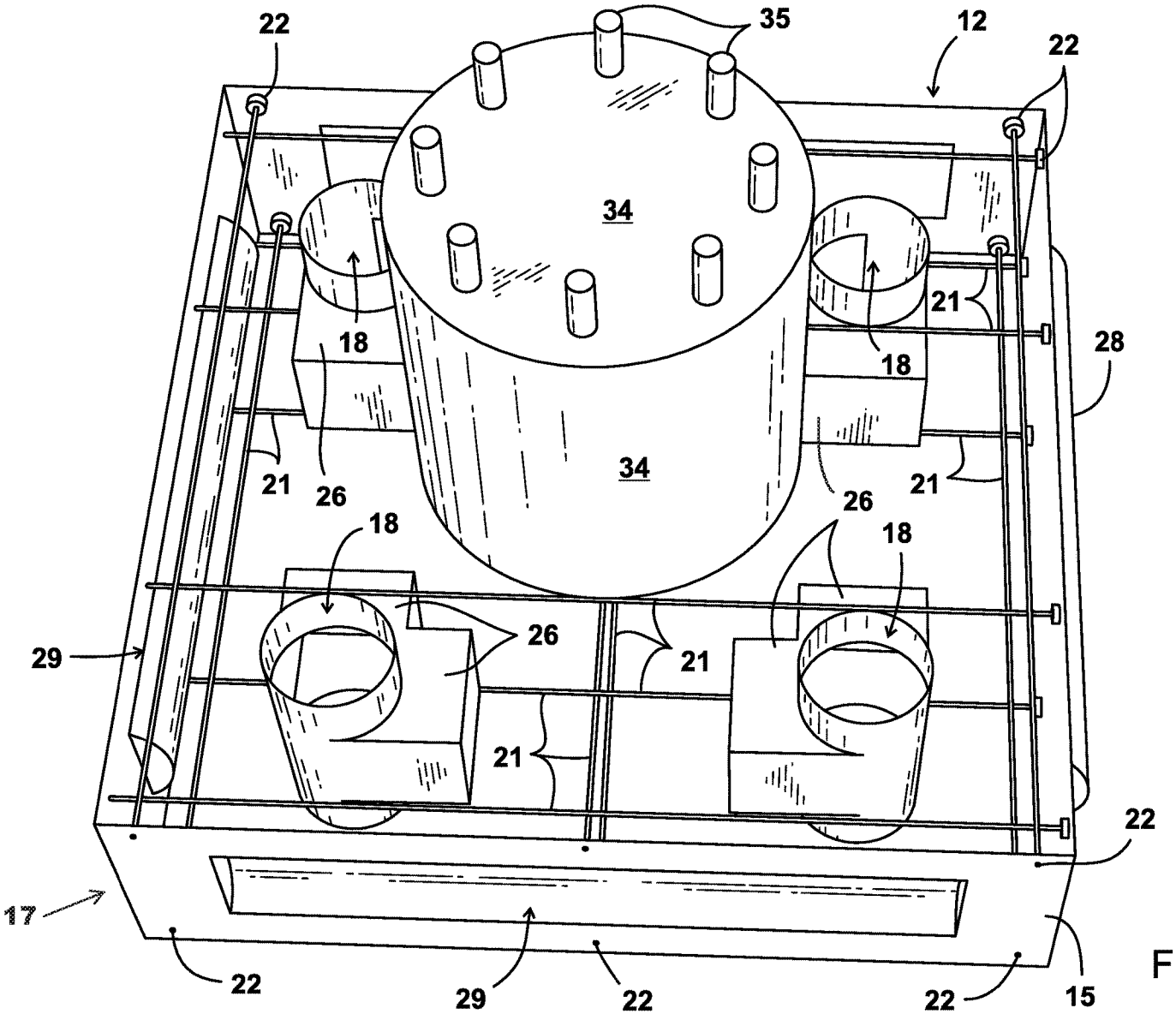
FIG. 3 is a partial sectional view of a preferred embodiment of the apparatus of the present invention.

In FIGS. 2-3, a plurality of open ended channels 22 can be provided through the blocks 12, each channel 22 preferably extending from one side portion 15 to a different side portion 15. At least two of the channels 22 can be spaced apart and in between a first and a second of the side portions 15, as seen in FIG. 3. At least two of the channels 22 can be spaced apart and in between a third and a fourth of the side portions 15, as seen in FIG. 3. Tensile cable members 21 (commercially available) preferably extend through multiple channels 22 of multiple of the blocks 12 and to the peripheral or outer edge portion 17 (see FIGS. 2-3). Cables 21 can be commercially available prestressing cables, post tension tendons or rods. In FIGS. 8 and 16, multiple blocks 12 form the array 16 with each rod or cable or tension member 21 extending through the channels 22 of multiple blocks 12 so that the entire array 16 can be prestressed. Prestressing the cables or rods 21 can be accomplished with known, commercially available tools/equipment.

One or more openings 18 (e.g., each preferably formed with a sonotube, commercially available) can be provided in each block 12. Openings 18 can be vertical openings. The one or more openings 18 each preferably extend from the upper surface 13 to the lower surface 14 of block 12. Each said opening 18 can be positioned in between two of said tensile cable members 21 as seen in FIG. 3. An inclined or vertical piling 19 preferably extends through or to the block opening 18. A load transfer interface can transfer load from each block 12 to one or more inclined or vertical piling 19. FIG. 3 shows a cut away view inside the concrete block 12. The post tension tendons using rods 21 can be seen in FIG. 3.

Figure 10:
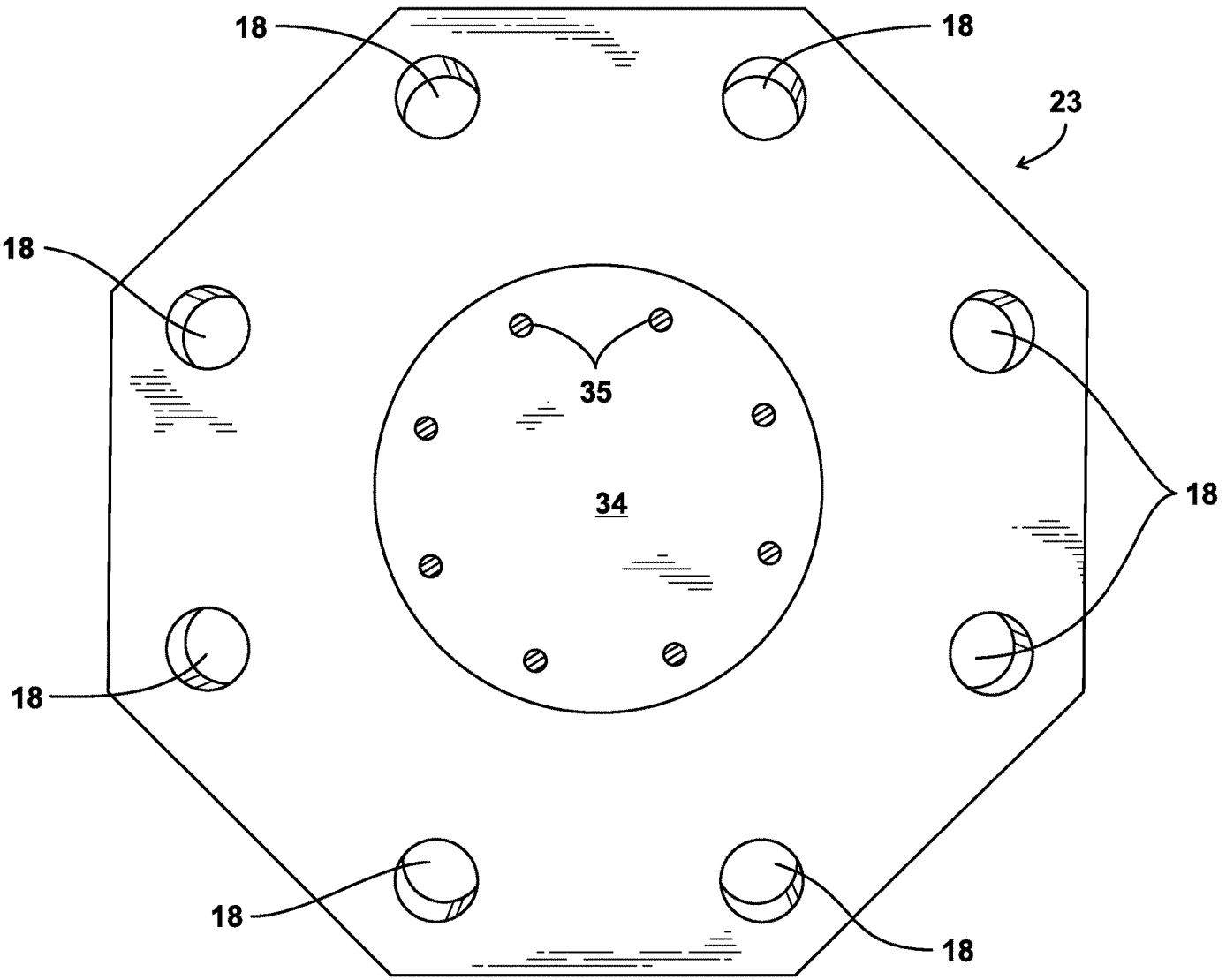
FIG. 10 is a fragmentary top view of an alternate embodiment of the apparatus of the present invention.
Figure 11:
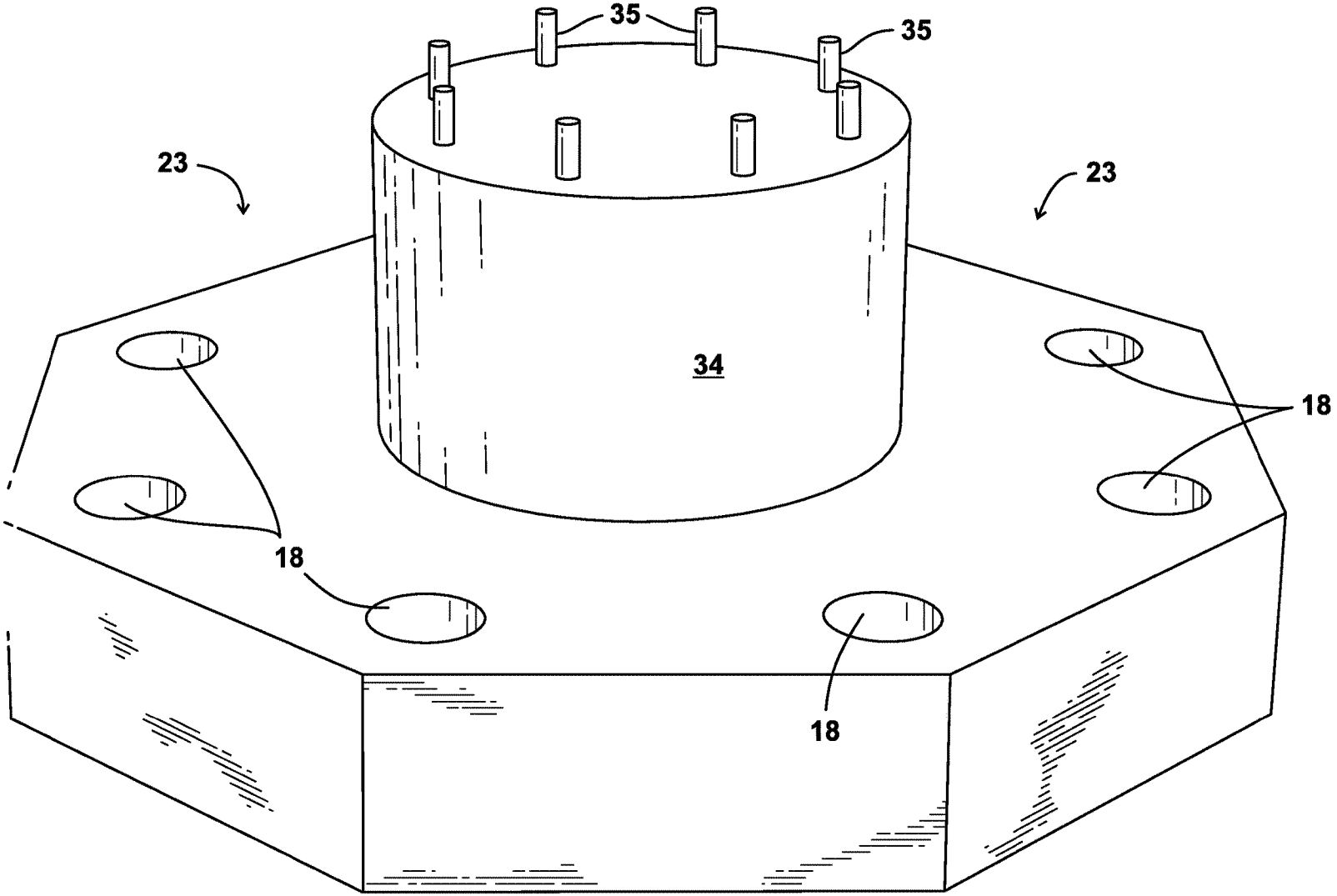
FIG. 11 is a partial perspective view of an alternate embodiment of the apparatus of the present invention.

In another embodiment (FIGS. 10-17), a single precast base 23 is preferably used as opposed to multiple blocks 12, as seen in FIG. 10. A single precast base using piers 23 can transfer a much higher load than a mat foundation which relies upon the near surface soil strengths and the weight of the mat for support. FIGS. 10-17 show a single a shaped pier 23 (i.e., octagonal). The pier 23 could also be circular, or any other shape. The single pier 23 preferably does not need other connecting foundations. Alternatively, a multi-based system can be used as seen in FIG. 8.

Figure 5:
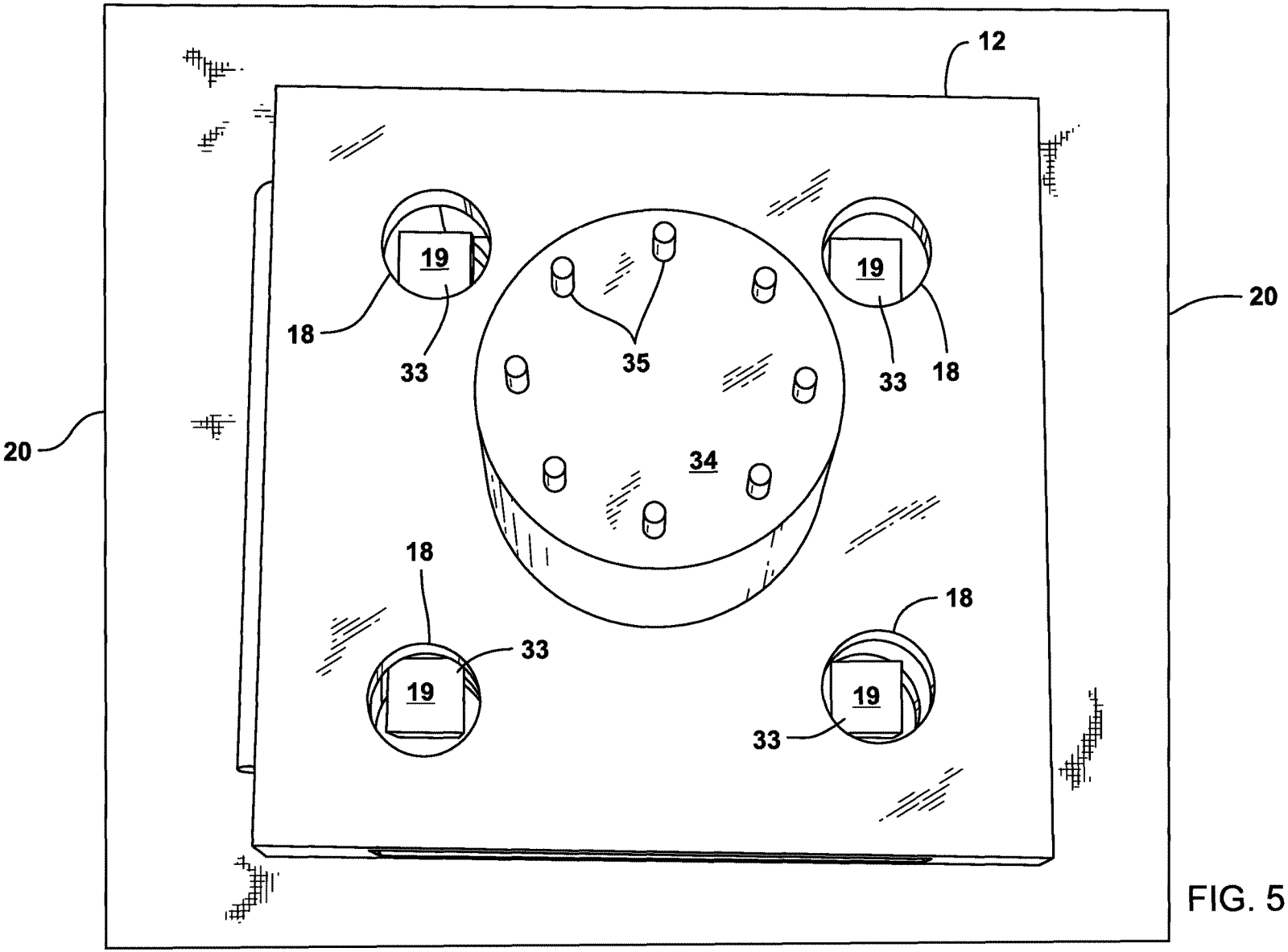
FIG. 5 is a partial perspective view of a preferred embodiment of the apparatus of the present invention.
Figure 6:
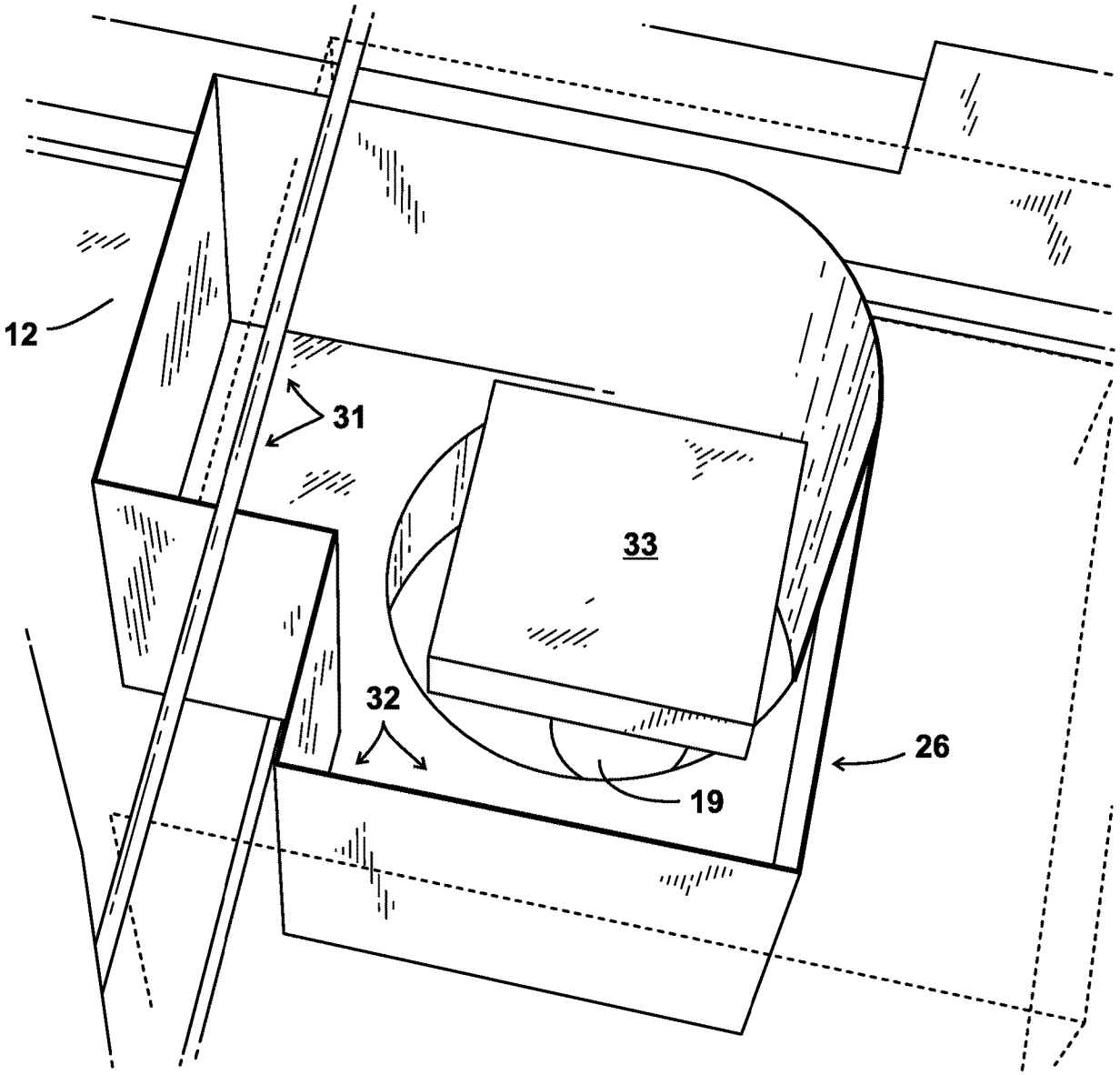
FIG. 6 is a fragmentary perspective view of a preferred embodiment of the apparatus of the present invention.
Figure 12:
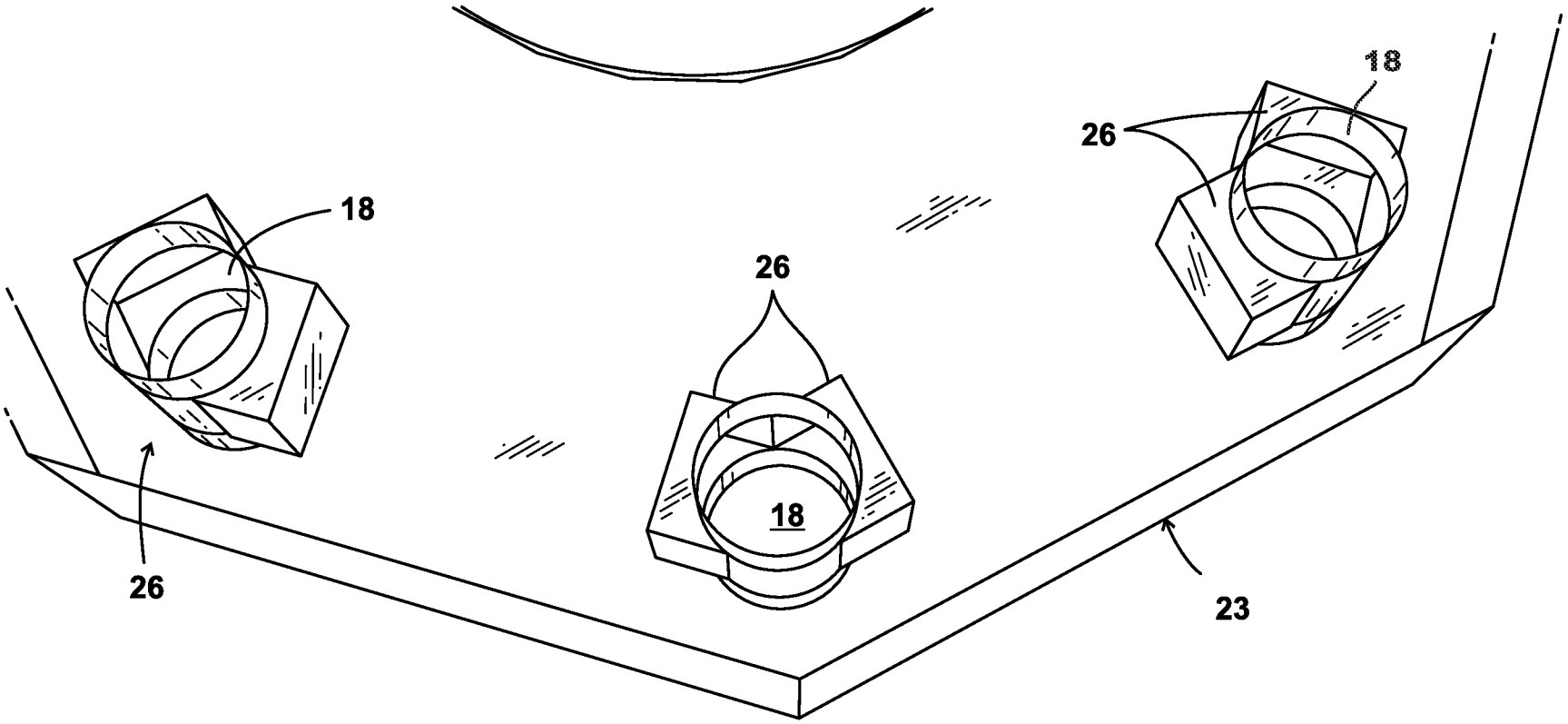
FIG. 12 is a partial perspective view of an alternate embodiment of the apparatus of the present invention.

FIGS. 3, 6 and 12 show shear keys 26 to prevent the piers 19 from punching through the slab. Each shear key 26 is preferably a voided area located between the top 13 and bottom 14 of a block 12. The shear key 26 is preferably adjacent to opening 18. Both opening 18 and shear key 26 would be filled with concrete or other filler material after block 12 is set on piers 19 at upper plates 33. Shear keys 26 can be used in either preferred or alternate embodiments. In FIGS. 3 and 6, each shear key 26 communicates with a vertical or inclined opening 18. Each key 26 preferably includes a laterally extending socket or sockets 31, 32. Each socket 31, 32 is preferably below block 12 upper surface 13 and above block 12 lower surface 14. Each shear key 26 can be about half the distance between upper surface 13 and lower surface 14 (see FIGS. 5 and 6). When a piling 19 occupies an opening 18, upper plate 33 is preferably at about the same level as shear key 26, preferably half way between upper surface 13 and lower surface 14.

To complete the interface between each piling 19 and each block 12, slurried (wet) concrete is preferably added to openings 18 and to each socket or void space 31, 32 of each key 26 thus preferably encapsulating plate 33 in concrete.

Figure 7:
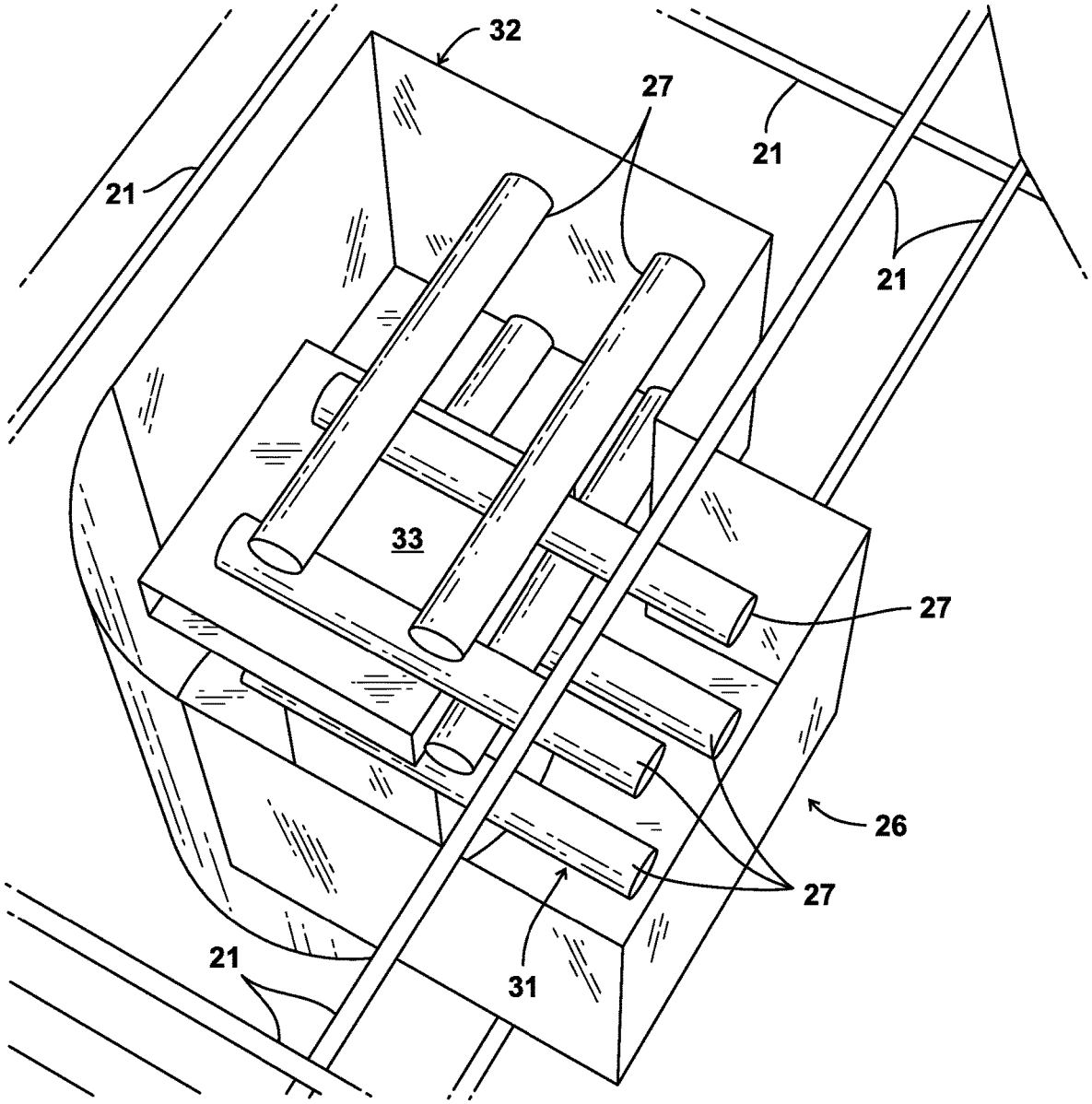
FIG. 7 is a fragmentary perspective view of a preferred embodiment of the apparatus of the present invention.
Figure 14:
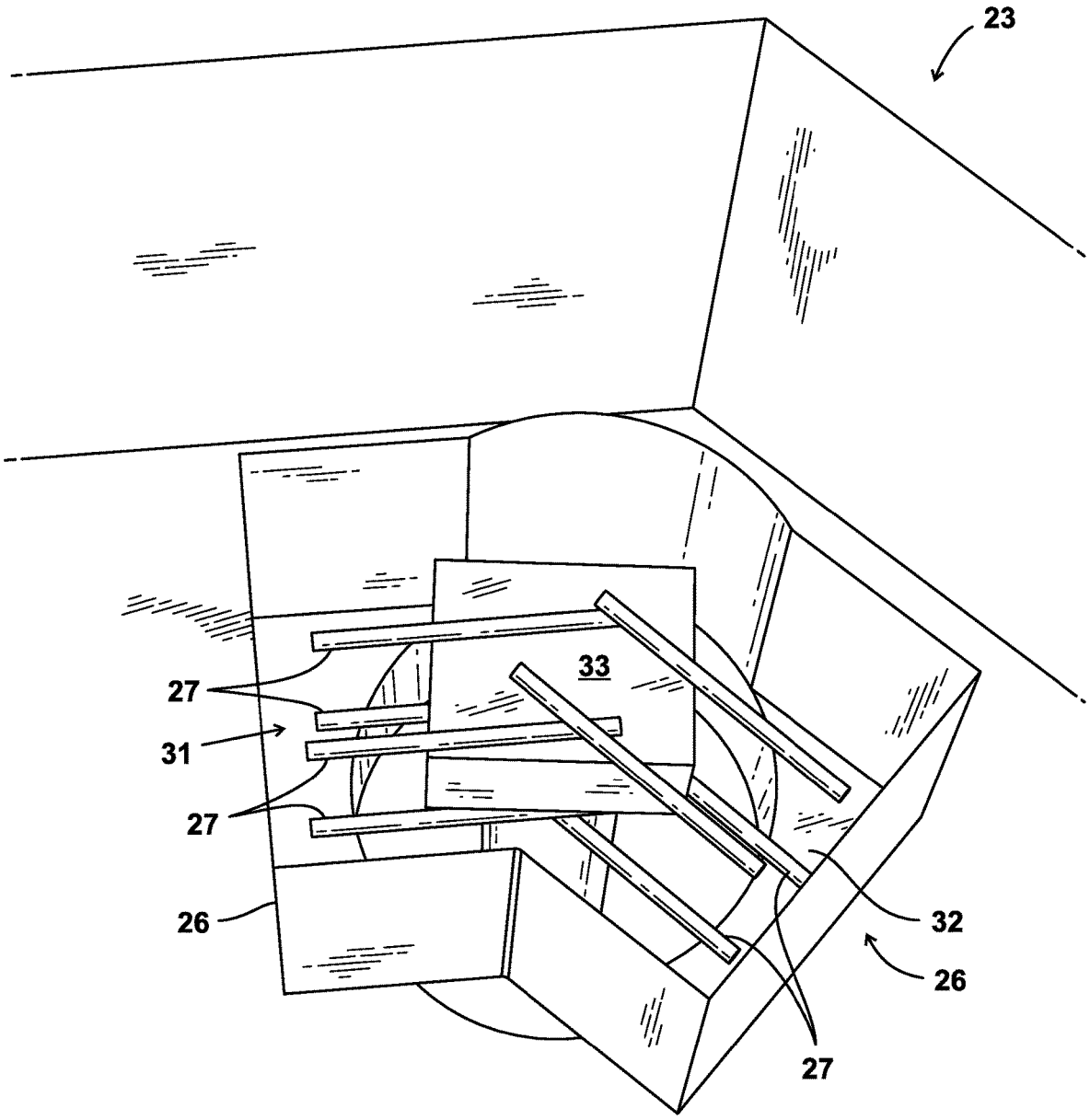
FIG. 14 is a fragmentary top view of an alternate embodiment of the apparatus of the present invention.
Figure 15:
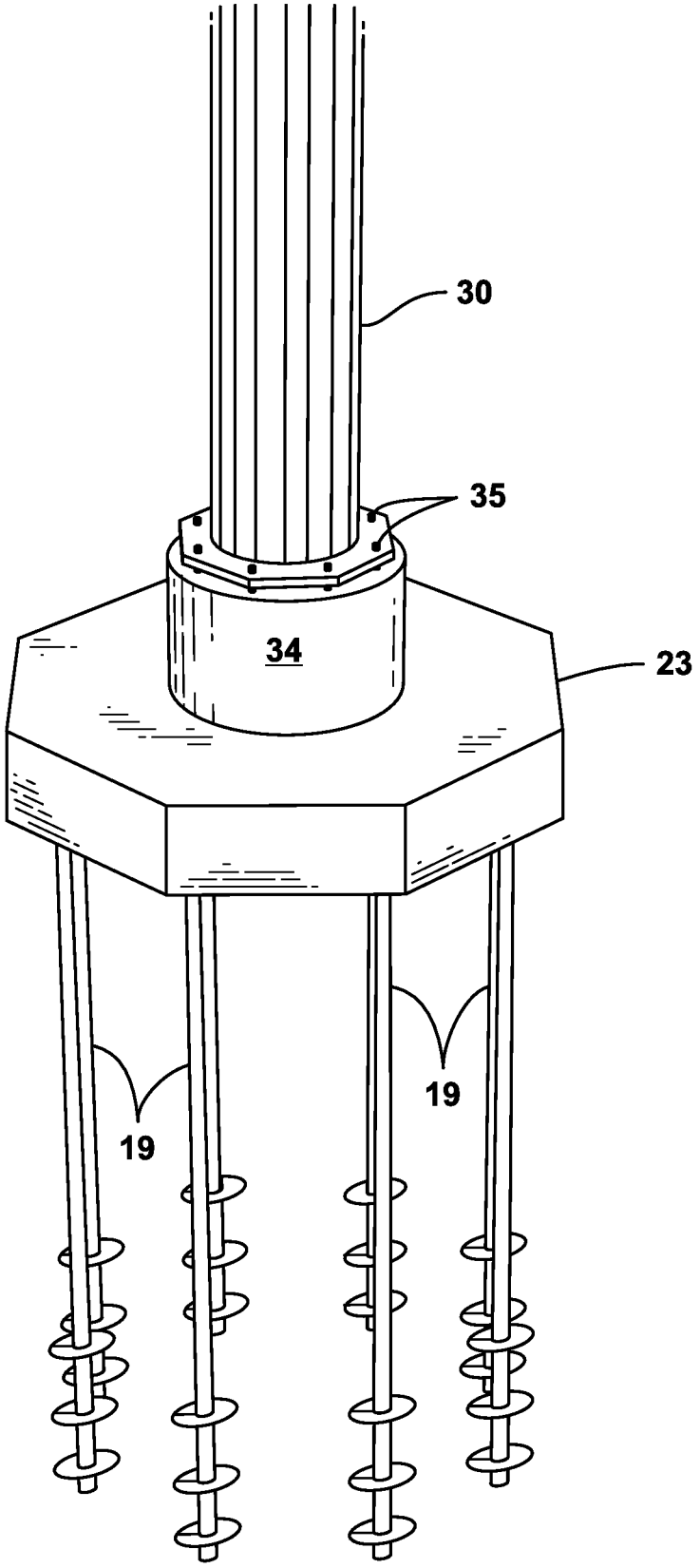
FIG. 15 is a partial perspective view of an alternate embodiment of the apparatus of the present invention.

FIGS. 7 and 14 show optional reinforcing bar (rebar) 27 in the keys 26. The bars 27 can be added into the holes 18 and keys 26 preferably after the foundation (blocks 12) is set on the piers or piling 19. Alternatively, the bars 27 can be placed when the blocks 12 are poured.

FIG. 16 shows the option of placing equipment 11 on the pier supported foundations. Since drilling piers or piling can be accomplished with a high tolerance of location during installation, the piers or piling can be drilled first, then the foundation could be set on the piers or piling.

Figure 4:
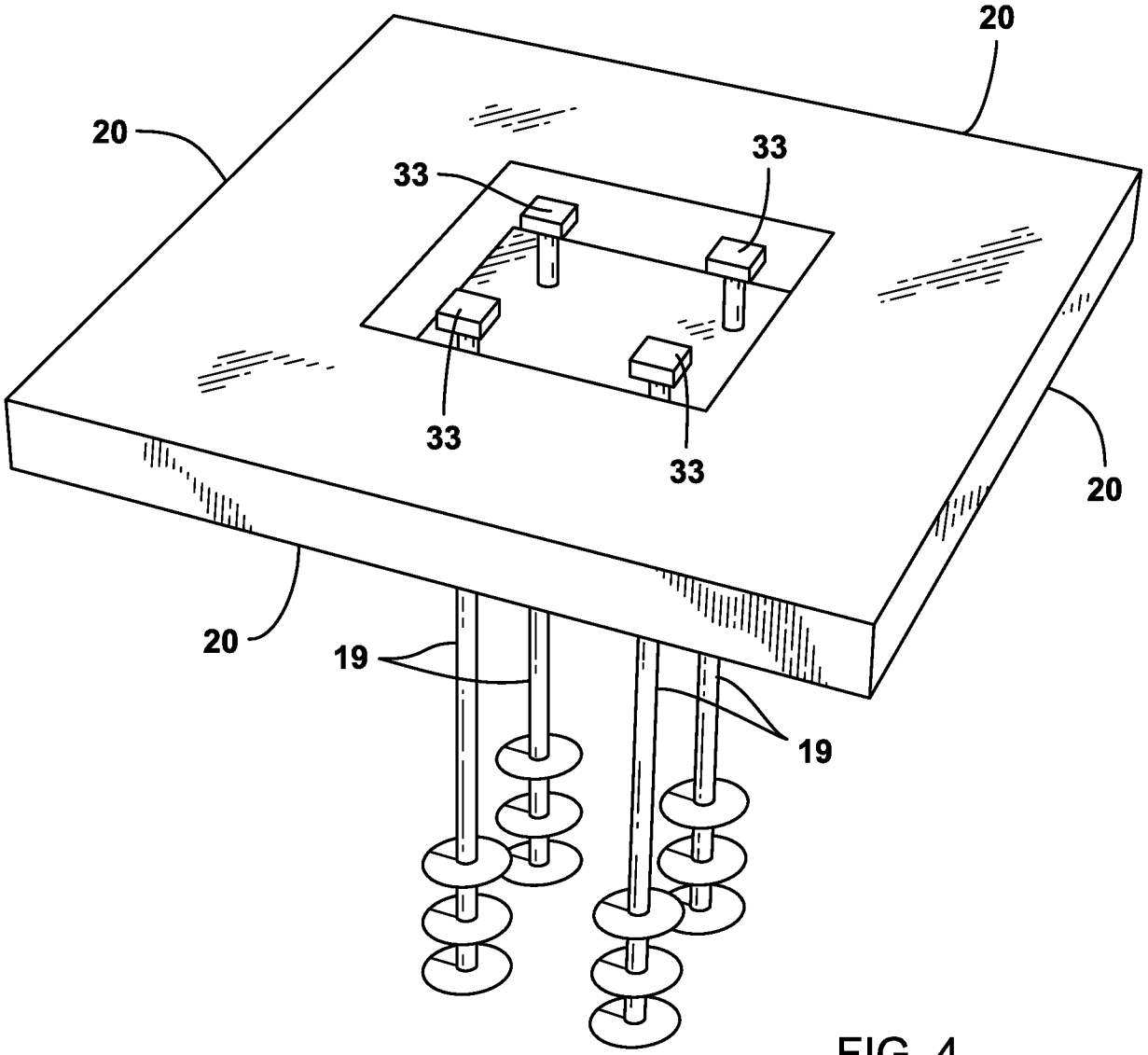
FIG. 4 is a perspective view of a preferred embodiment of the apparatus of the present invention.
Figure 13:
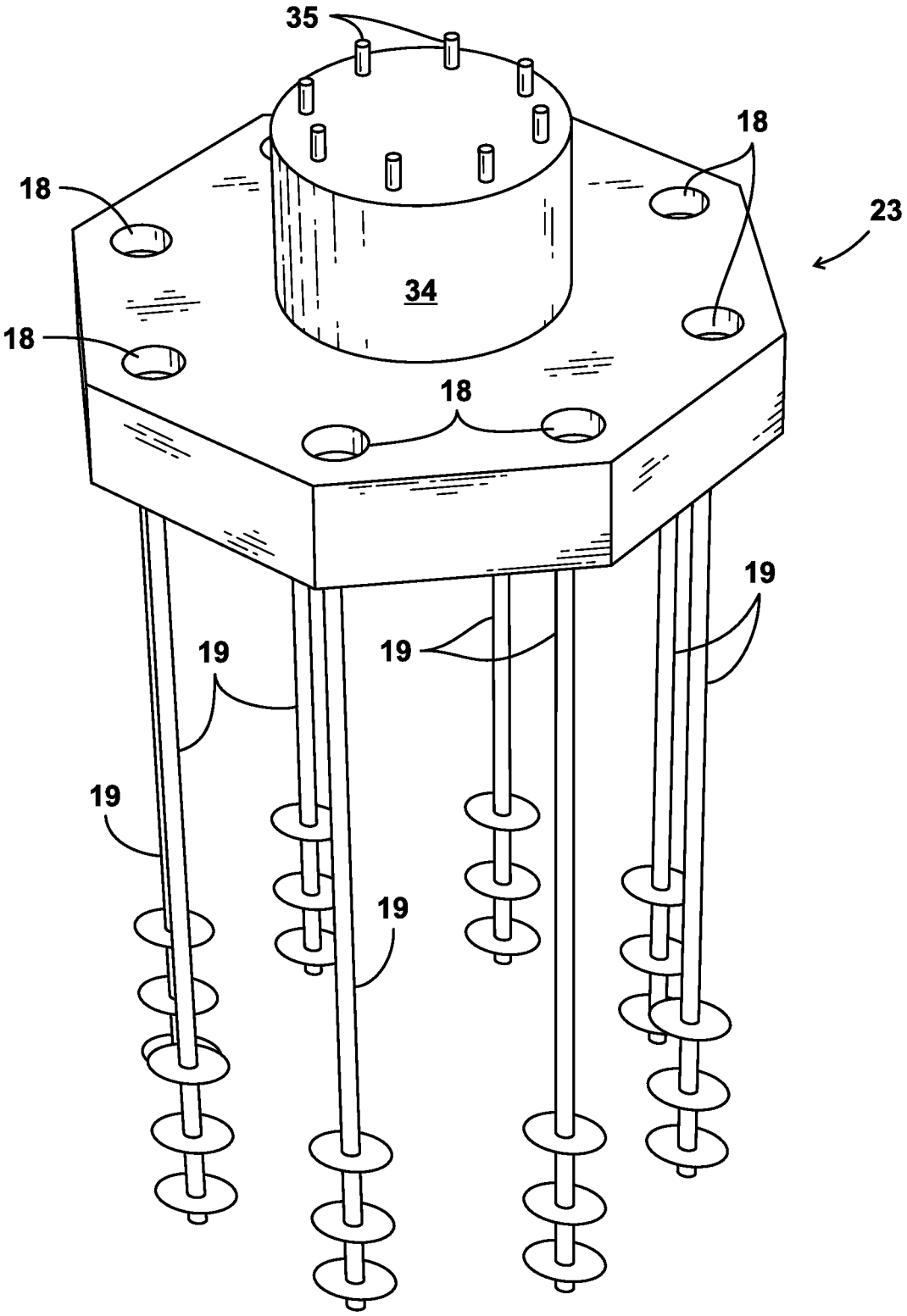
FIG. 13 is a perspective view of an alternate embodiment of the apparatus of the present invention.

Steps for installation can include:

1) Clear site to a leveled elevation as determined by the engineer.
2) Drill the piers into place leaving the top of the piers above grade 20 approximately ½ the thickness of the precast foundation (see FIG. 4)
3) Set the foundation(s) on the piers, lining up the center of the block outs with the piers (see FIGS. 5 & 13).

4) Install/pull post tension tendons (if required).
5) Set reinforcing bars 27, then fill block out with keys in the field with slurried (wet) concrete.
6) Allow the slurried (wet) concrete to set (harden).
7) Install the tower 30.

Figure 17:
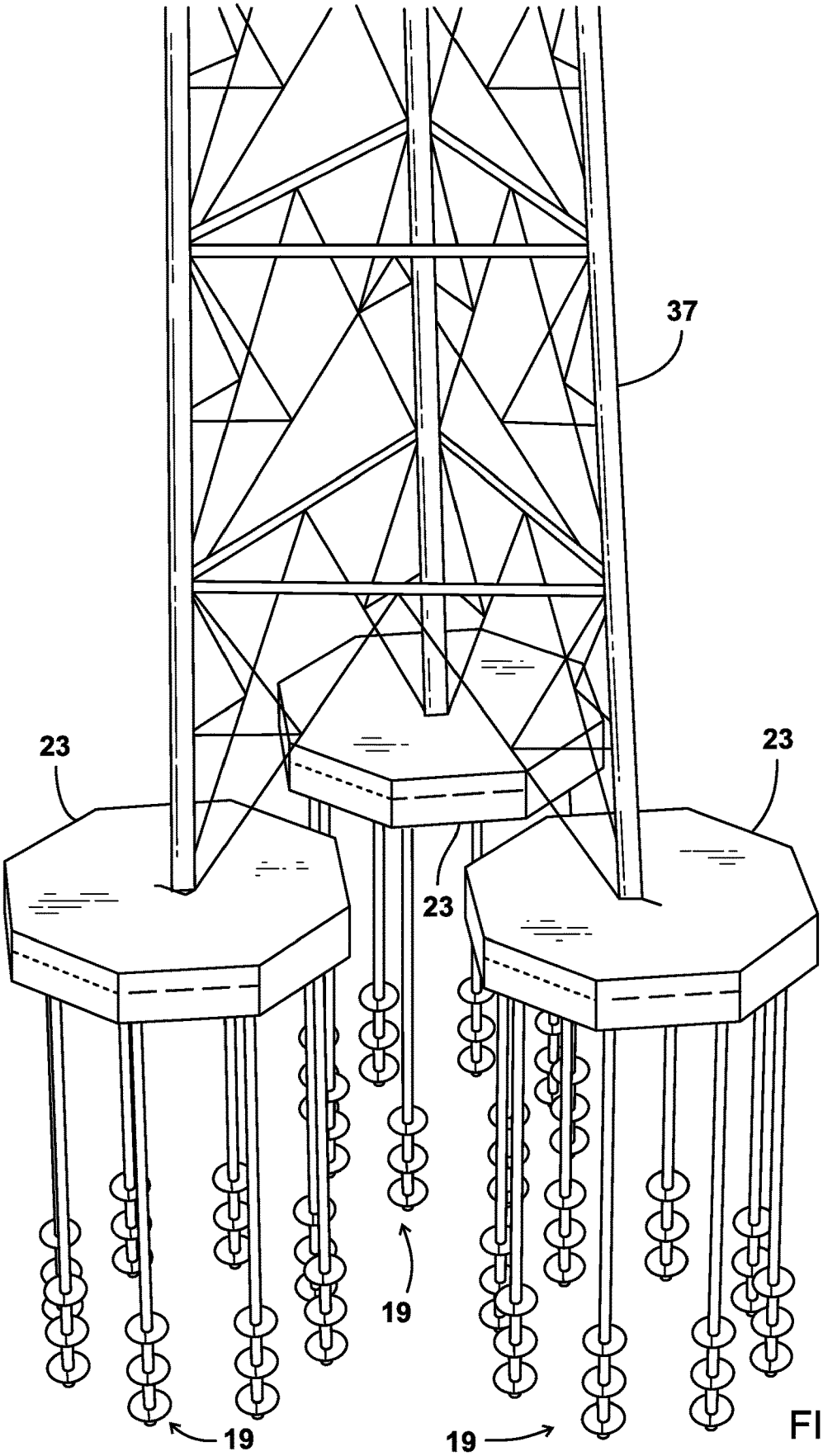
FIG. 17 is a fragmentary perspective view of an alternate embodiment of the apparatus of the present invention.
Figure 18:
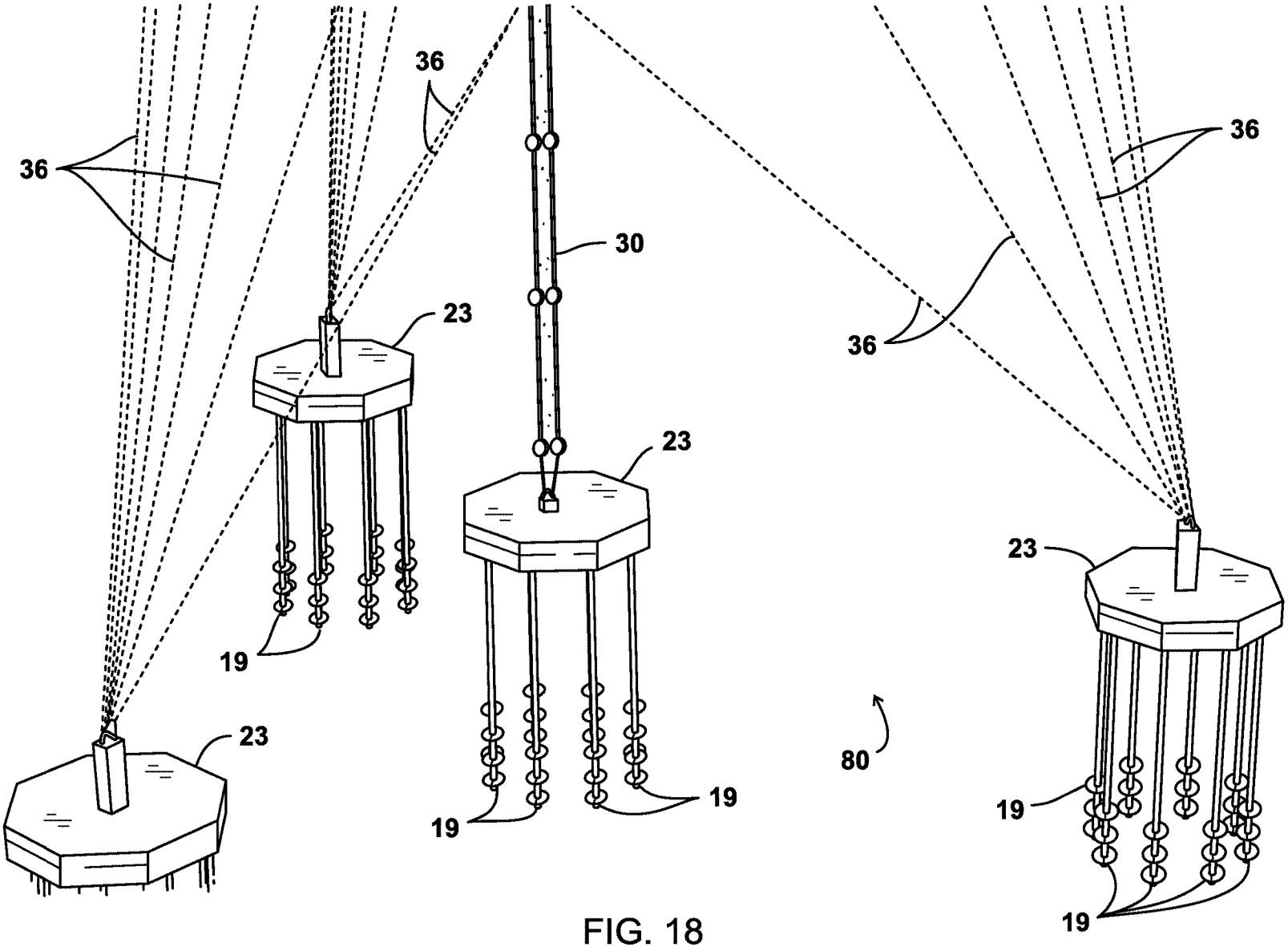
FIG. 18 is a fragmentary perspective view of an alternate embodiment of the apparatus of the present invention.

The system of the present invention can be used for single poles 30, multi leg towers 37 (FIG. 17), or a guyed tower 80 (including bases/piers 23, cables 36, tower section 30 and anchors 19—see FIG. 18). A multi leg tower 37 can be placed on one (1) mat consisting of several precast foundations, or three (3) separate individual foundations 23 as seen in FIG. 17.

The piers or piling 19 are preferably vertical, as seen in the figures. Alternatively, the piers 19 could be installed at a batter (inclination) to take up the shear forces in the tower.

Besides towers, this deep foundation system of the present invention can be used for heavy equipment or other structures like buildings, generators, containers, etc., especially in remote areas where concrete trucks may have difficulty accessing the site.

Figure 19:
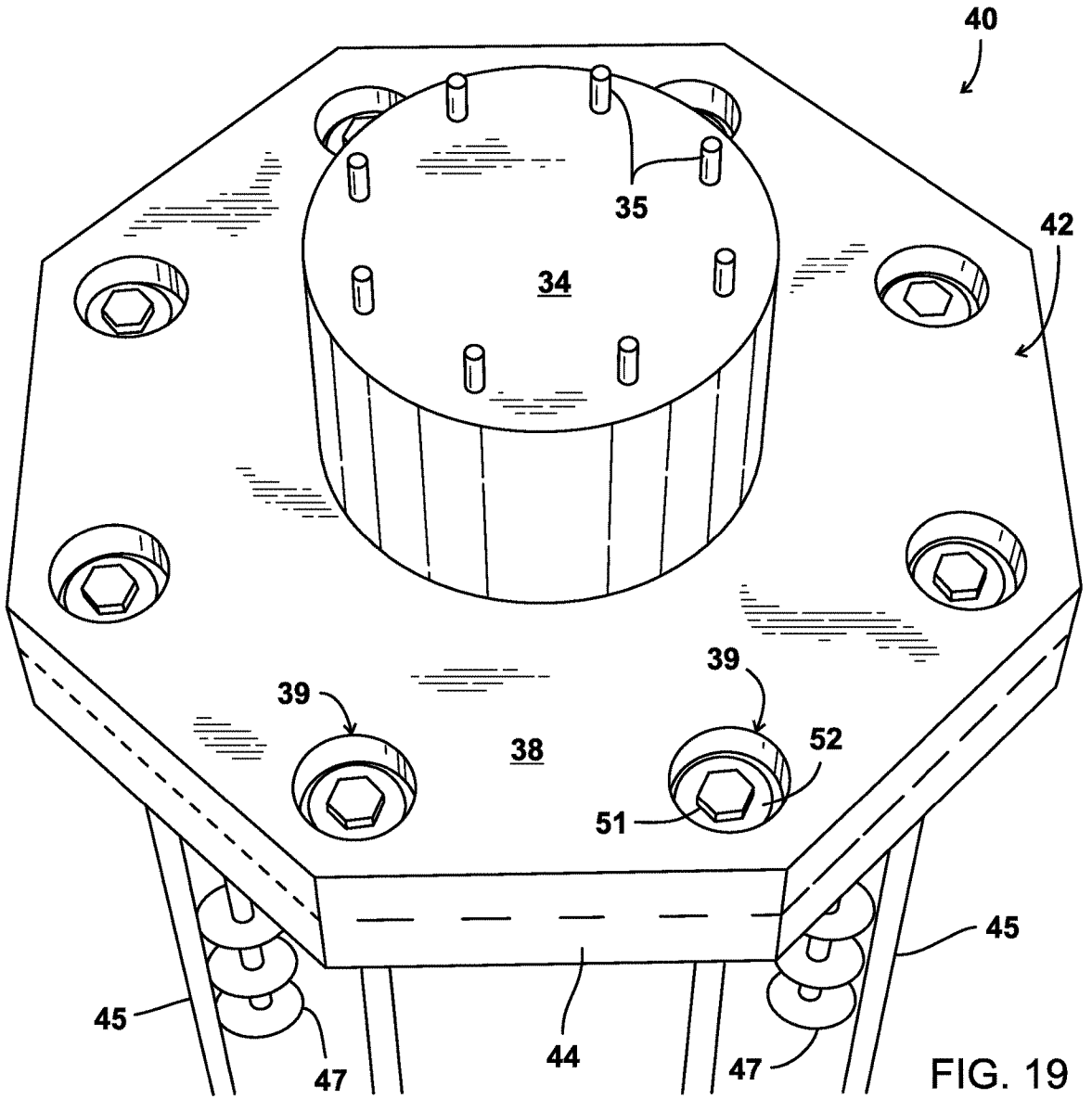
FIG. 19 is a partial perspective view of a third embodiment of the apparatus of the present invention.
Figure 20:
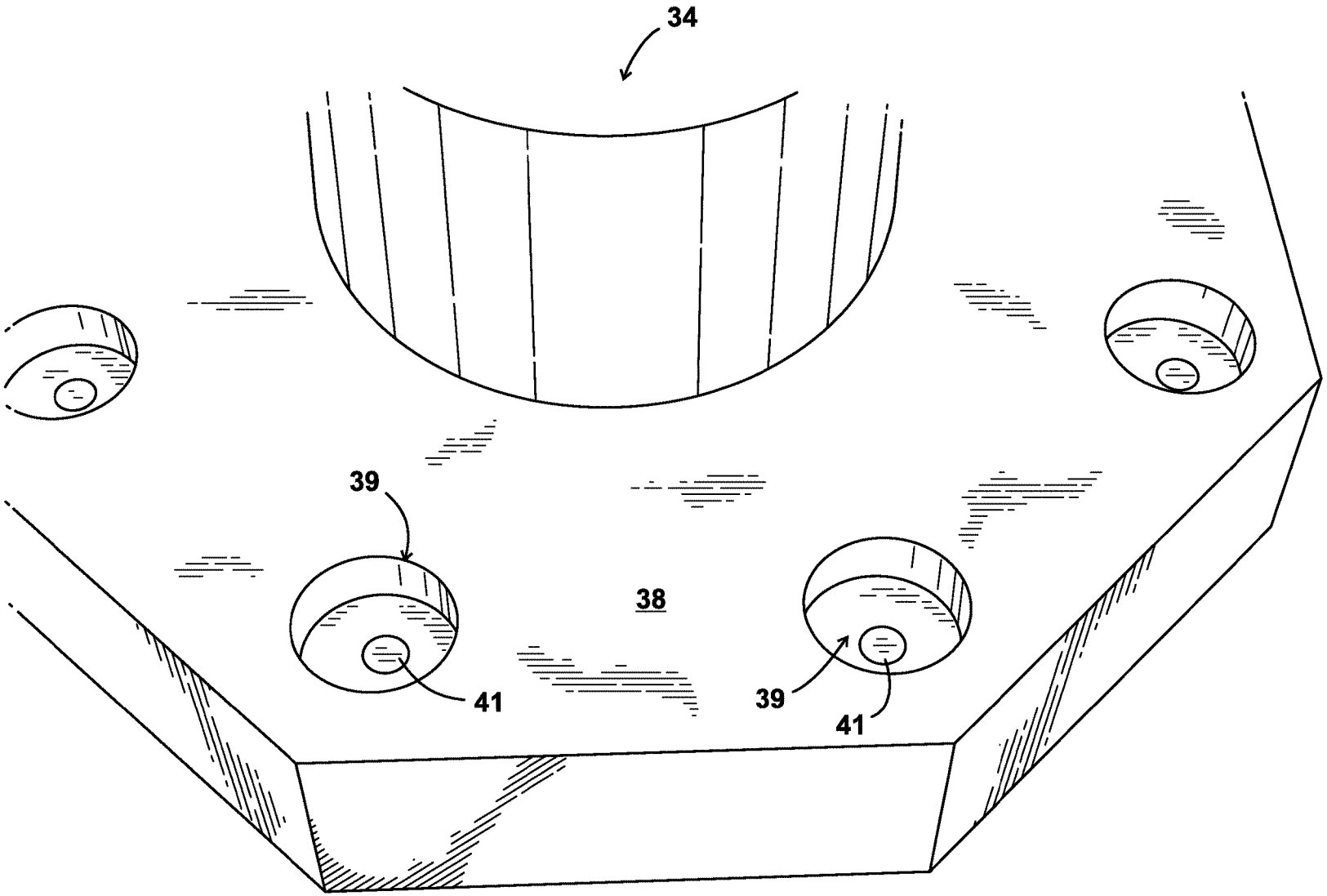
FIG. 20 is a partial perspective view of a third embodiment of the apparatus of the present invention.
Figure 21:
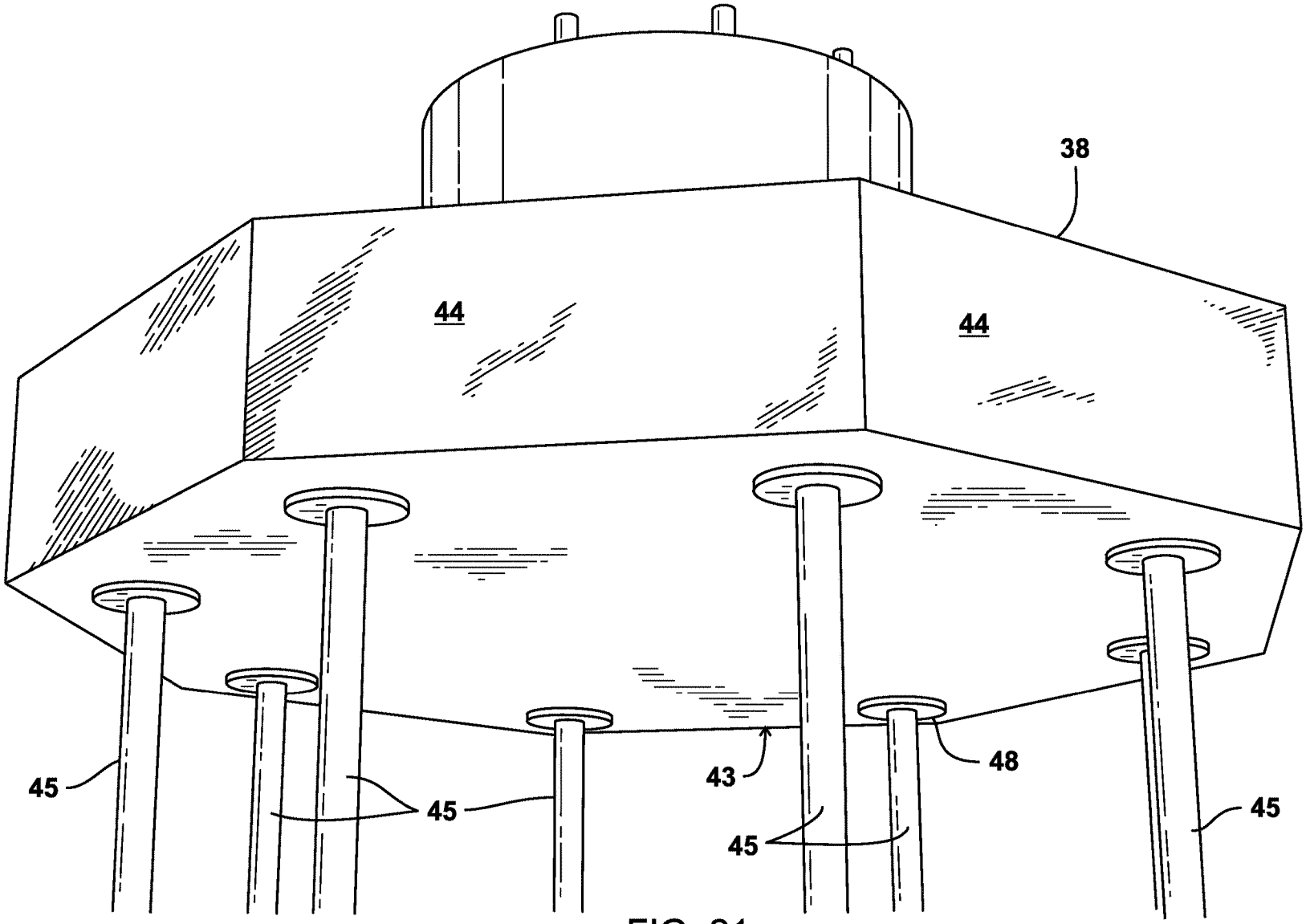
FIG. 21 is a fragmentary perspective view of a third embodiment of the apparatus of the present invention.
Figure 22:
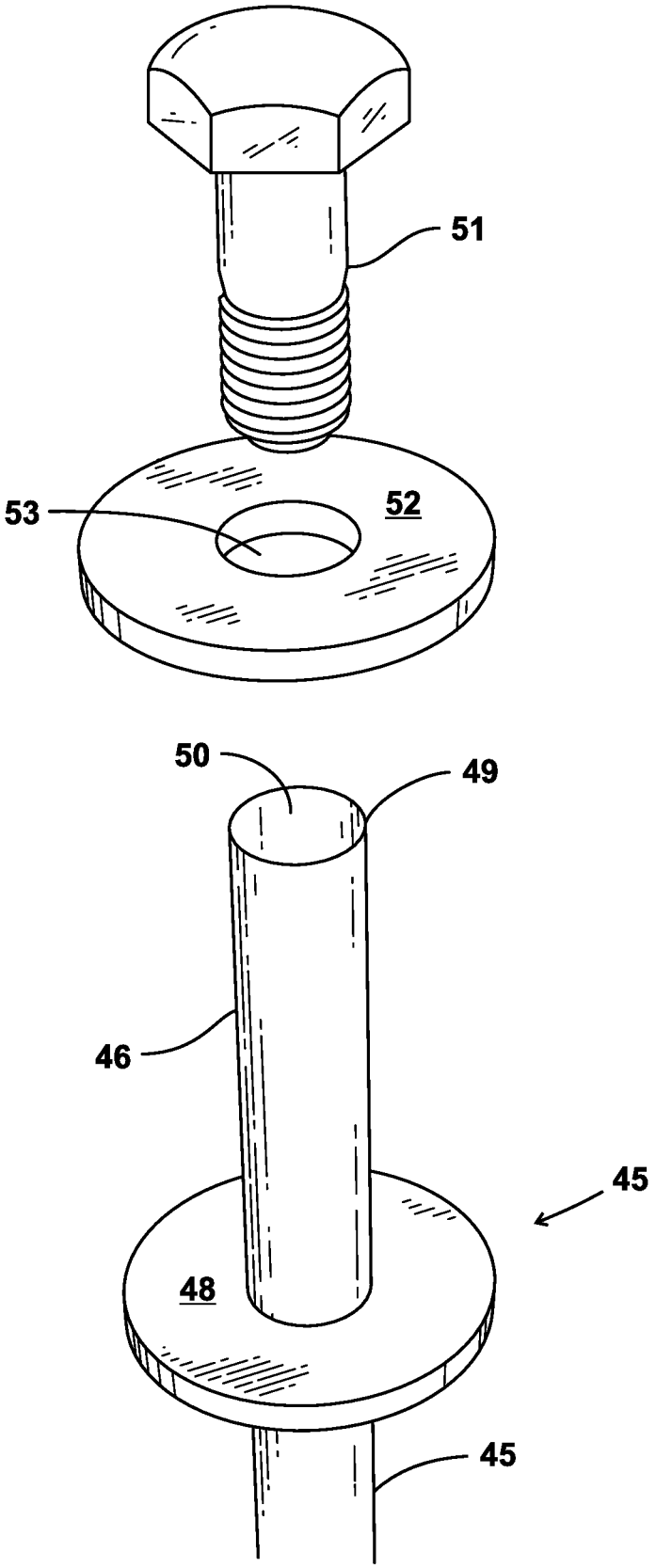
FIG. 22 is a fragmentary perspective view of a third embodiment of the apparatus of the present invention.

FIGS. 19-22 show a third embodiment 40 that uses a specially configured piling and pier or pedestal foundation. FIG. 20 shows a base or pier 38 that is preferably similar to pier/base 23 but having sockets 39 and openings 41. Base or pier 38 has upper surface 42, lower surface 43 and side portions 44. In FIGS. 19-21, the base/pier 38 can have a suitable shape with eight (8) side portions 44. Each opening 41 preferably extends from lower surface 43 upwardly to a socket 39. Piling 45 can have lower auger portions 47 similar to the lower end portions of piling 19. Upper end 46 of piling 45 preferably has a plate 48 that is preferably spaced a distance from end 49 (see FIG. 22). Upper end portion 46 can have an internally threaded bore 50 that is preferably receptive of threaded bolt 51. Plate 52 preferably occupies socket 39. Bolt 51 preferably extends through opening 53 of plate 52 to connect with threaded bore 50. Plate 48 transfers compressive load from base 38 to piling 45 while plate 52 and bolt 51 are preferably used to transfer uplift load from pier or base 38 to piling 45. In an alternative embodiment, upper end portion 46 can have an externally threaded bore 50 that is preferably receptive of a nut 51 with internal threads and can be placed over upper end portion 46.

FIGS. 23-26 show a fourth embodiment of the apparatus of the present invention, designated generally by the numeral 54. Foundation system 54 includes a frame 55 which are preferably attached cylindrical or tubular members or cans 56. In one embodiment, frame 55 is preferably of welded steel construction and cylindrical or tubular members or cans 56 are preferably welded to frame 55.

Figure 23:
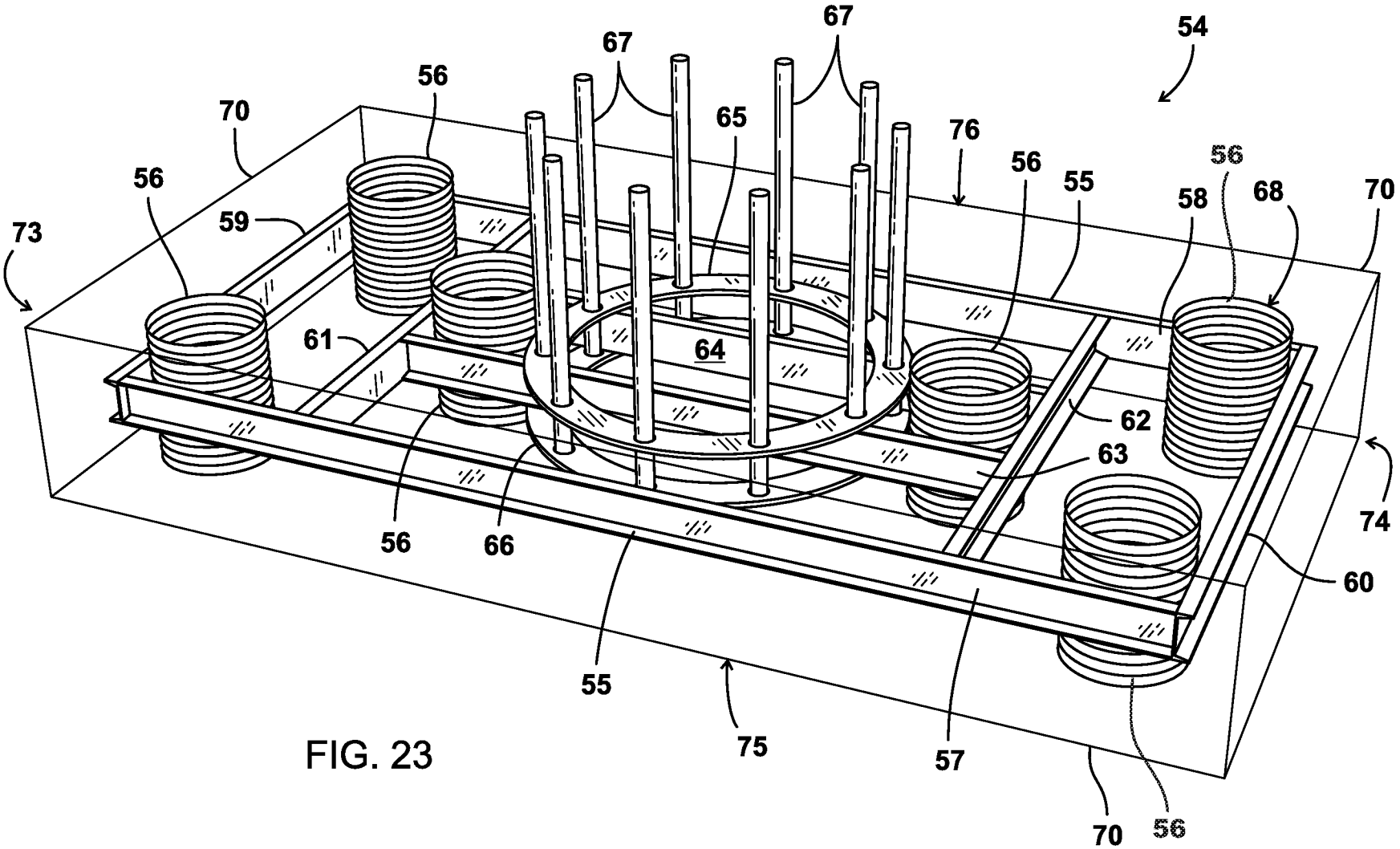
FIG. 23 is a perspective view of a fourth embodiment of the apparatus of the present invention.

Frame 55 preferably has side beams 57, 58 and end beams 59, 60. Transverse beams 61, 62 each preferably span from one side beam 57 to another side beam 58 as seen in FIG. 23. Longitudinally extending inner beams 63, 64 each preferably extend from one transverse beam 61 to another transverse beam 62 as seen in FIG. 23. End beams 59, 60 are preferably welded or otherwise connected (e.g., bolts, fasteners) to side beams 57, 58. Transverse beams 61, 62 are each preferably welded or otherwise connected to side beams 57, 58.

In FIG. 23 there are six (6) cans 56. A can 56 is preferably located at each corner of frame 55 as seen in FIG. 23. Two (2) cans 56 are preferably located in between beams 63, 64 and on opposing sides of rings 65, 66. The rings 65, 66 can include upper ring 65 and lower ring 66. A plurality of anchor bolts, rods or externally threaded members 67 are preferably attached (e.g., welded) to rings 65, 66 as seen in FIG. 23. One (upper) ring 65 is preferably positioned above frame 55 and can be welded to the upper surfaces of beams 63, 64. The other (lower) ring 66 can be attached (e.g., welded) to the lower surfaces of beams 63, 64.

Figure 24:
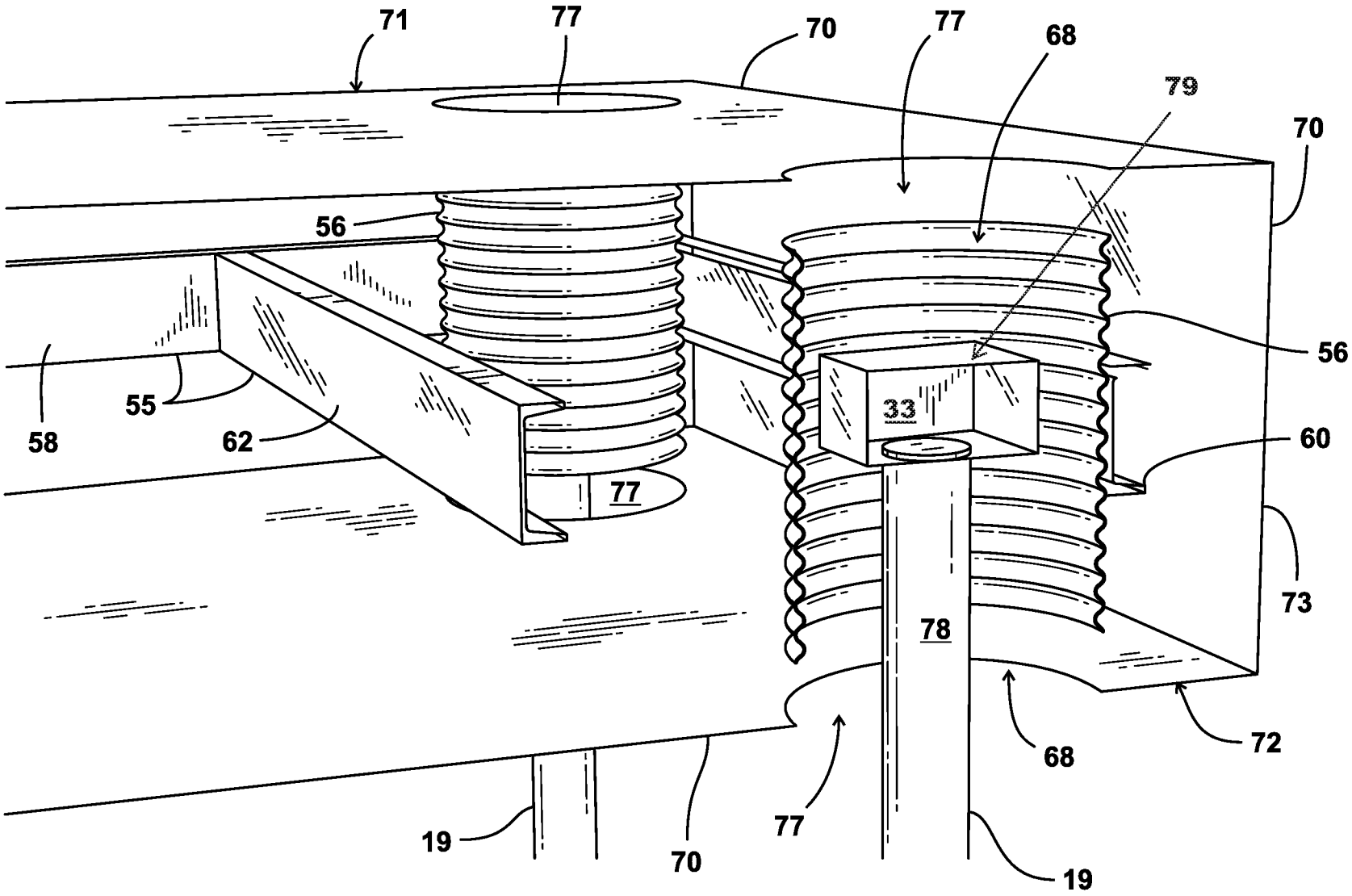
FIG. 24 is a partial perspective view of a fourth embodiment of the apparatus of the present invention.

Frame 55, cans 56 and rings 65, 66 can be imbedded in concrete mass/slab 70. Thus each can 56 is preferably below slab upper surface 71 and above slab lower surface 72 as seen in FIG. 24. Each can 56 preferably has an open ended bore 68. Slab 70 preferably has a vertically extending opening 77 that preferably extends above and below each can 56 as seen in FIG. 24. Each opening 77 preferably extends from slab upper surface 71 to lower surface 72 as seen in FIG. 24.

Figure 25:
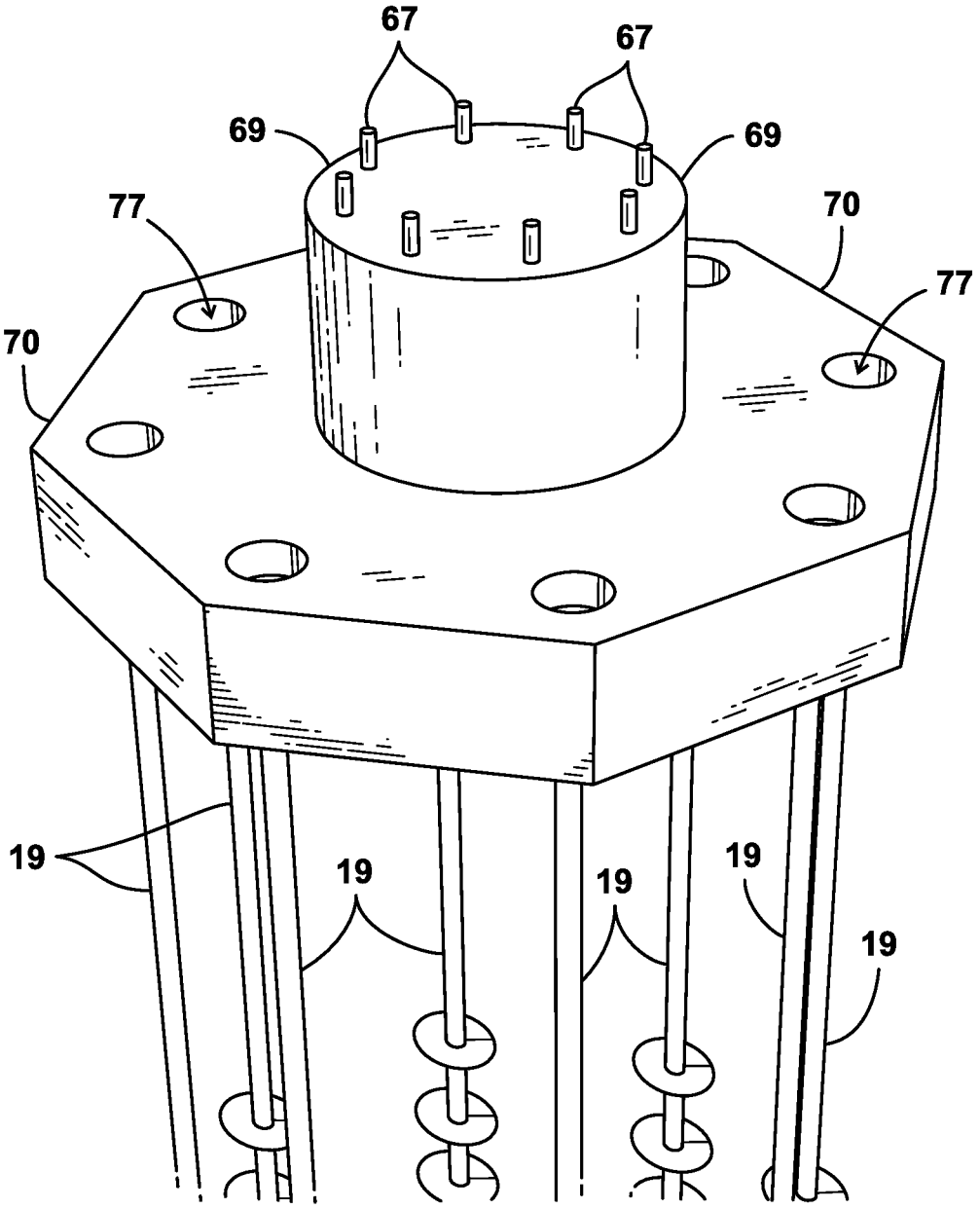
FIG. 25 is a perspective view of a fourth embodiment of the apparatus of the present invention.
Figure 26:
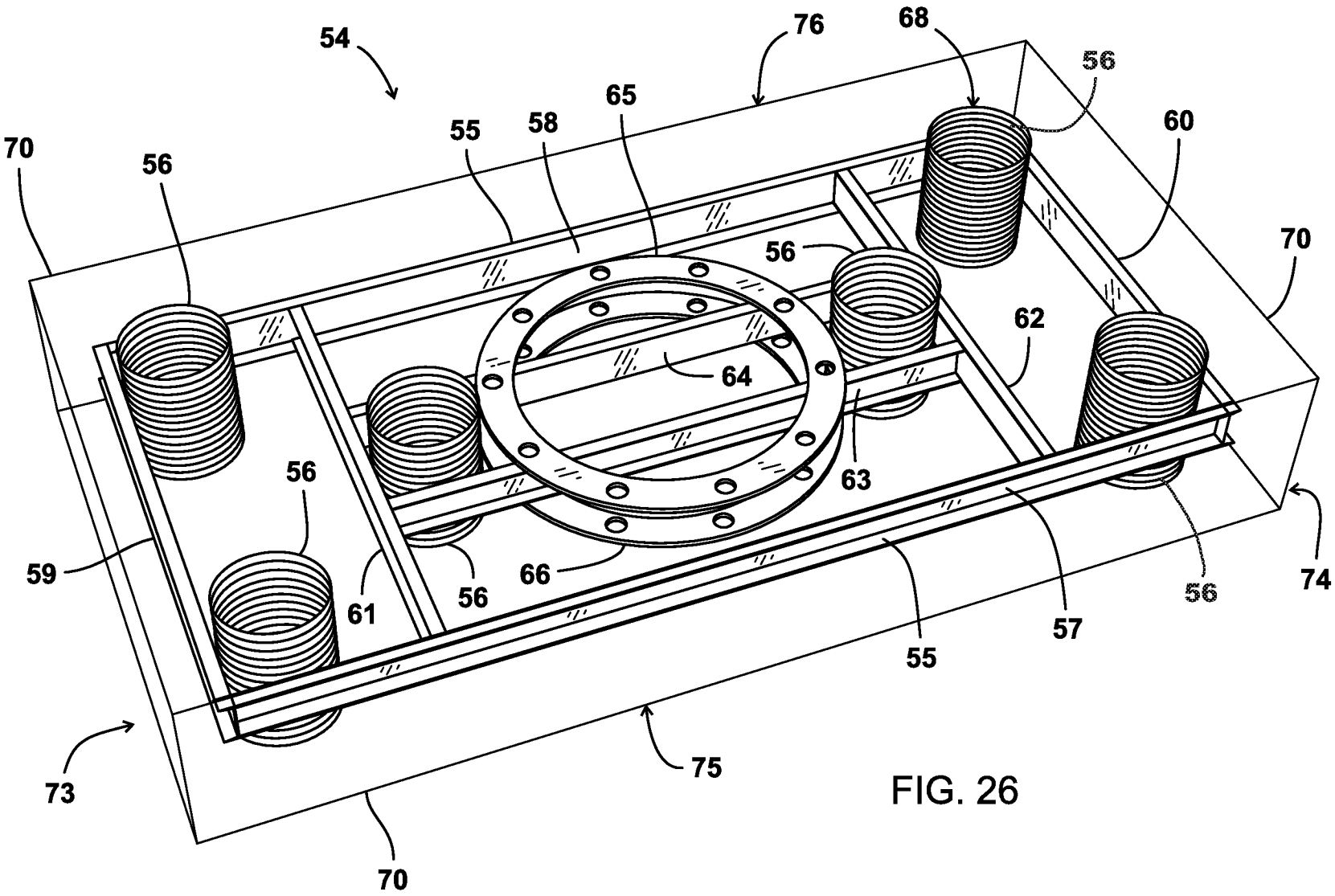
FIG. 26 is a perspective view of a fourth embodiment of the apparatus of the present invention.

Frame 55 can be spaced inwardly of slab end surfaces 73,74. Frame 55 can be spaced inwardly of slab side surfaces 75, 76. A pedestal 69 can be added to (or cast in place as a part of) slab 70 as seen in FIG. 25. FIG. 25 also illustrates that slab 70 can be shapes other than the rectangular shape of FIG. 23, providing an octagonal shape. Anchor bolts, rods or externally threaded members 67 can extend a selected distance above pedestal 69 as seen in FIG. 25. A tower can then be mounted on pedestal 69, bolting the tower to the pedestal 69 rising anchor blots or threaded members 67.

In FIGS. 24, 25 piling 19 can be mounted within open ended bore 68 of a can 56 and extending into slab 70 via vertically extending slab opening 77 as seen in FIG. 24. The upper end portion 78 of each piling 19 can be provided with a plate (e.g., 33 as with earlier embodiments-see FIGS. 4, 5, 6, 7, 14) or multiple plates forming an anchor 79. The vertically extending openings 77 and can 56 open ended bores 68 can be filled with a high strength grout that preferably encapsulates plate 33 or anchor 79 and upper end portion 78 of each piling 19.

The following is a list of parts and materials suitable for use in the present invention:

PARTS LIST

Part Number Description

10 foundation system
11 building/superstructure/housing
12 block
13 upper surface
14 lower surface
15 side portion
16 mat/array of blocks
17 edge/peripheral portion
18 opening/sonotube
19 piling
20 soil mass/grade
21 cable member/rod/tension rod
22 chase/channel
23 base/pier
24 row of blocks
25 column of blocks
26 shear key
27 reinforcing bar
28 projection/longue and groove male key
29 recess/groove/tongue and groove female key
30 tower/tower section
31 shear key socket/void space
32 shear key socket/void space
33 upper plate
34 pedestal
35 anchor bolt
36 cable
37 multi-leg tower

38 base/pier
39 socket
40 foundation
41 opening
42 upper surface
43 lower surface
44 side portions
45 piling
46 upper end portion
47 auger portion
48 plate
49 end
50 threaded bore (internal threads)
51 bolt
52 plate
53 plate opening
54 foundation system
55 frame
56 cylindrical member, tubular member, can
57 side beam
58 side beam
59 end beam
60 end beam
61 transverse beam
62 transverse beam
63 longitudinally extending inner beam
64 longitudinally extending inner beam
65 upper ring
66 lower ring
67 anchor bolt, rod externally threaded member
68 open ended bore
69 pedestal
70 concrete mass/concrete slab
71 upper surface
72 lower surface
73 end surface
74 end surface
75 side surface
76 side surface
77 vertically extending slab opening
78 upper end portion
79 anchor
80 guyed tower All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A deep foundation system, comprising;

a) a plurality of concrete blocks, each said block having an upper surface, a lower surface and a plurality of side portions, each side portion extending from said upper surface to said lower surface, said plurality of blocks having a peripheral portion, a side portion of one said block positioned next to one or more other said blocks;

b) a plurality of open ended channels through said blocks, each channel extending from one side portion to a different of said side portions;

c) at least two of said channels being spaced apart and in between a first and a second of said side portions;

d) at least two of said channels being spaced apart and in between a third and a fourth of said side portions;

e) tensile cable members that each extend through multiple channels of multiple said blocks and to said peripheral portion;

f) multiple vertically extending openings in each said block, said openings extending from said upper surface to said lower surface, each said opening being in between two of said tensile cable members;

g) a vertical or inclined piling extending into each said vertically extending opening, wherein the piling has an upper end with a transverse plate that is positioned in between said upper and lower surfaces; and h) a load transfer interface that transfers load from each said block to a said vertical or inclined piling at said transverse plate.

2. The system of claim 1 wherein said tensile cable member is tensioned so that said blocks are post tensioned.

3. The system of claim 1 further comprising a structure supported by said blocks and vertical pilings.

4. The system of claim 1 wherein said interface includes a mass of concrete that is poured into each said block opening, said mass engaging said transverse plate.

5. The system of claim 1 wherein said interface includes reinforced steel that is partially imbedded in each said block and that extends into said block opening.

6. A deep foundation system, comprising:

a) a concrete base that has upper and lower surfaces;

b) multiple spaced apart, vertically extending openings in said concrete base, each said opening lined with a can, each can having an open ended bore;

c) a frame embedded in said concrete base, said frame connected to each of said cans;

d) multiple pilings having upper and lower piling end portions, said upper end portion extending into a said can open ended bore;

e) a mass of grout in each said can open ended bore; and f) wherein said mass of grout encapsulates a said upper piling end portion.

7. The deep foundation system of claim 6 wherein each said can has a corrugated can side wall.

8. The deep foundation system of claim 6 wherein said frame includes multiple beams.

9. The deep foundation system of claim 8 wherein said beams include a first plurality of beams and a second plurality of beams, each beam of said second plurality of beams welded to one or more beams of said first plurality of beams.

10. The deep foundation system of claim 8 wherein said beams include perimeter beams and inner beams, each inner beam spaced in between two (2) said perimeter beams.

11. The deep foundation system of claim 6 wherein said cans include corner cans and one or more interior cans that are spaced inwardly of said corner cans.

12. The deep foundation system of claim 9 wherein a beam of said first plurality is welded or connected to a beam of said second plurality at a frame corner.

13. The deep foundation system of claim 12 wherein a can is connected to said frame at a said frame corner.

14. The deep foundation system of claim 4 wherein each vertically extending opening includes one or more laterally extending shear keys or sockets, each shear key or socket being a void space that is spaced below said upper surface and above said lower surface.

15. The deep foundation system of claim 4 further comprising a pedestal that extends above said plurality of blocks.

16. The deep foundation system of claim 15 further comprising a tower structure that connects to said pedestal.

17. The deep foundation system of claim 1 wherein each block connects to another said block with a tongue and groove interface.

18. The deep foundation system of claim 1 wherein each said vertically extending opening has a width larger than the maximum width of each said piling upper end.

19. The deep foundation system of claim 14 wherein the said mass of concrete extends into each said shear key or laterally extending socket.

20. A deep foundation system, comprising:

a) a concrete base that has upper and lower surfaces;

b) multiple spaced apart cans, each can having an open ended bore that extends to said upper and lower surfaces;

c) a frame embedded in said concrete base, said frame connected to each of said cans;

d) multiple pilings having upper and lower piling end portions, said upper end portion extending into a said can open ended bore;

e) a mass of grout in each said can open ended bore; and f) wherein said mass of grout encapsulates a said upper piling end portion.

* * * * *